US005104778A

United States Patent [19]

Yamanouchi et al.

[11] Patent Number: 5,104,778

[45] Date of Patent: Apr. 14, 1992

[54] SILVER HALIDE PHOTOSENSITIVE MATERIAL

[75] Inventors: Junichi Yamanouchi; Kazuhiko Takeuchi, both of Kanagawa, Japan

[73] Assignee: Fuji Photo Film Co., Ltd., Kanagawa, Japan

[21] Appl. No.: 528,507

[22] Filed: May 25, 1990

[30] Foreign Application Priority Data

May 26, 1989 [JP] Japan ..... 1-134156

[51] Int. Cl.[5] ..... G03C 1/06

[52] U.S. Cl. ..... 430/518; 430/559; 430/627; 430/637; 430/941

[58] Field of Search ..... 430/213, 518, 559, 637, 430/941, 627

[56] References Cited

FOREIGN PATENT DOCUMENTS 01229245 9/1989 Japan ..... 430/518

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A silver halide photosensitive material is disclosed, comprising a support having thereon at least one silver halide photosensitive layer and at least one layer containing an acidic dye, a cationic polymer mordant and gelatin, wherein said mordant containing layer further contains a dispersion of an anionic polymer thickener represented by formula (I):

$$(A)_x(B)_y(E)_z \qquad (I)$$

wherein A represents a repeating unit derived from a monomer component having at least two copolymerizable ethylenically unsaturated groups, at least one unsaturated group of which is copolymerized in a side chain of the polymer; B represents a repeating unit derived from a monomer component having a single copolymerizable ethylenically unsaturated group; E represents a repeating unit derived from a copolymerizable ethylenically unsaturated monomer component having at least one anionic functional group; x, y and z represent the mol percentages of the repeating units A, B and E respectively, and x is from 0 to 50 mol %, y is from 0 to 99 mol %, and z is from 1 to 90 mol %.

6 Claims, No Drawings

SILVER HALIDE PHOTOSENSITIVE MATERIAL

FIELD OF THE INVENTION

This invention concerns a silver halide photosensitive material, and particularly concerns a silver halide photosensitive material comprising at least one layer containing an acidic dye, a polymeric mordant and gelatin, said photosensitive material further comprising a compound which increases the viscosity of the coating liquid containing the polymeric mordant without adversely affecting the state of the coated surface thereof.

BACKGROUND OF THE INVENTION

Silver halide photosensitive materials are generally prepared by coating a gelatin solution having dispersed therein the silver halide and other additives onto a support comprised of triacetylcellulose or poly(ethylene terephthalate), for example. The use of various coating promotors for uniformly coating the constituent layers in the preparation of such silver halide photosensitive materials is well known in the art. From among these coating promoters, anionic polymers such as poly(-potassium styrenesulfonate), are often used in order to adjust the viscosity of the coating liquid.

For example, increasing the viscosity of a coating liquid by adding thereto polymers having anionic groups is disclosed, for example, in JP-A-49-115311, JP-A-51-81123, JP-A-52-67318, JP-A-53-39118, JP-A-53-39119, JP-A-57-105471, JP-A-61-203451, British Patents 676,459 and 1,539,866, and U.S. Pat. Nos. 3,022,172, 3,655,407, 3,705,798 and 3,811,897. (The term "JP-A" as used herein signifies an "unexamined published Japanese patent application".)

However, undesirable results frequently arise when these anionic polymers are used in layers which also contain polymers having cationic sites. For example, if an anionic polymer is added to a layer containing a cationic polymer for mordanting anti-halation dyes, the anionic polymer reacts with the cationic mordant, such that coating may become impractical as a result of aggregation, or the state of the coated surface may become adversely affected.

Furthermore, the anti-halation dyes may be released from the mordant by reaction with an anionic polymer. This results in the anti-halation dye being released from the anti-halation layer and diffusing into an adjacent emulsion layer. Adverse effects then occur such as a loss of photographic speed.

Suppressing aggregation with the mordant and achieving an effective increase in viscosity by using macromolecular copolymers of acrylamide and monomers which have —COOH groups (for example acrylic acid) as thickeners is disclosed in JP-B-49-21655 as a means of overcoming these problems. (The term "JP-B" as used herein signifies an "examined Japanese patent publication".)

However, thickeners of this type do not always have adequate viscosity increasing properties such that they must be used in large quantity. When thickeners of this type are added in large amount to layers containing gelatin and a polymer mordant, the adhesion at the boundary surface with the adjacent layer is often adversely affected.

SUMMARY OF THE INVENTION

A first object of the present invention is to provide a novel anionic polymer thickener having excellent viscosity increasing properties in a mordant containing solution, and which is diffusion first.

A second object of the present invention is to provide a silver halide photosensitive material having excellent dye retention in the mordant layer, wherein the retention property is enhanced as a result of establishing the mordant layer using the above described thickener.

A third object of the present invention is to provide novel anionic polymer thickener which does not have an adverse effect on inter layer adhesion properties, and which increases the viscosity of the mordant containing liquid.

A fourth object of the present invention is to provide a photosensitive material having an excellent coated surface state.

The above object have been realized by providing a silver halide photosensitive material comprising a support having thereon at least one silver halide photosensitive layer and at least one layer containing an acidic dye, a cationic polymer mordant and gelatin, wherein said mordant containing layer further contains a dispersion of an anionic polymer thickener represented by the general formula (I): General Formula (I)

$$\text{-}(A)_x\text{-}(B)_y\text{-}(E)_z\text{-}$$

wherein A represents repeating unit derived from a monomer component having at least two copolymerizable ethylenically unsaturated groups, at least one unsaturated of which is copolymerized in a side chain of the polymer. B represents a repeating unit derived from a monomer component having a single copolymerizable ethylenically unsaturated group. E represents a repeating unit derived from a copolymerizable ethylenically unsaturated monomer component having at least one anionic functional group. Moreover, x, y and z represent the mol percentages of the repeating units A, B and E respectively, and x is from 0 to 50 mol % y is from 0 to 99 mol %, and z is from 1 to 90 mol %.

DETAILED DESCRIPTION OF THE INVENTION

The compound represented by general formula (I), i.e., the anionic polymer thickener of the present invention is described in detail below.

Examples of the monomer component from which the repeating unit A is derived include divinylbenzene, ethyleneglycol dimethacrylate, diethyleneglycol dimethacrylate, triethyleneglycol dimethacrylate, ethyleneglycol diacrylate, diethyleneglycol diacrylate, 1,6-hexanediol diacrylate, neopentylglycol dimethacrylate and tetramethylene dimethacrylate. Of these, divinylbenzene and ethyleneglycol dimethacrylate are especially desirable.

Examples of the ethylenically unsaturated monomer component from which the repeating unit B is derived from include ethylene, propylene, 1-butene, isobutene, styrene, α-methylstyrene, vinyl ketone, monoethylenically unsaturated esters of aliphatic acids (for example, vinyl acetate, allyl acetate), esters of ethylenically unsaturated mono-carboxylic acids or dicarboxylic acids (for example, methyl methacrylate, ethyl methacrylate, n-butyl methacrylate, n-hexyl methacrylate, cyclohexyl methacrylate, benzyl methacrylate, n-butyl acrylate, n-hexyl acrylate, 2-ethylhexyl acrylate), mono-ethylenically unsaturated compounds (for example acrylonitrile) and dienes (for example butadiene, isoprene), and of these, styrene, n-butyl methacrylate and methyl methacrylate, for example, are especially desirable. The repeating unit B may be derived from two or more of the above described monomer components.

The repeating unit E is derived from a copolymerizable ethylenically unsaturated monomer component having an anionic functional group. Preferred examples of the anionic functional group include —COOH, —$SO_3H$, —$SO_2H$,

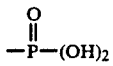

or salts thereof, and —COOH, —$SO_3H$, —$SO_2H$ and the salts thereof are preferred.

Nonlimiting examples of the ethylenically unsaturated monomer component having an anionic functional group from which the repeating unit E is derived from are indicated below.

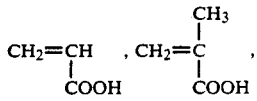

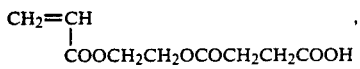

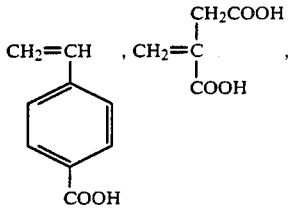

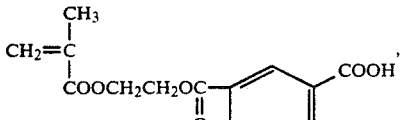

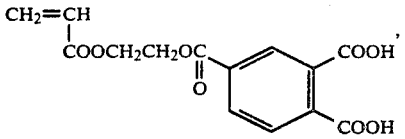

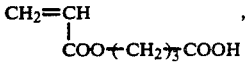

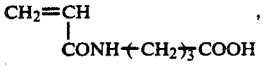

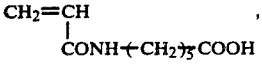

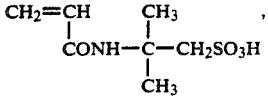

-continued

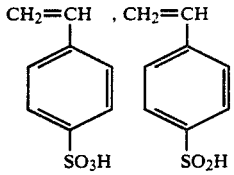

The monomer component having an anionic functional group may be included in the main chain of the polymer in the form of a salt, for example, an alkali metal salt (for example a Na or K salt) or an ammonium salt (for example a salt with ammonia, methylamine or dimethylamine).

The repeating unit represented by E may be derived from a single type of monomer component, or from two or more types of monomer components.

Moreover, x, y and z represent the mol percentages of the repeating unit, A, B and E respectively, and x is from 0 to 50 mol %, y is from 0 to 99 mol %, and z is from 1 to 90 mol %. When x is 0 mol %, y is preferably from 50 to 99 mol %, and z is preferably from 1 to 50 mol %, and most desirably y is from 70 to 95 mol % and z is from 5 to 30 mol %. When x does not equal 0 mol %, preferably x is from 0.1 to 50 mol %, y from 0 to 90 mol %, and z is from 1 to 80 mol %, and most desirably x is from 3 to 50 mol %, y is from 0 to 80 mol %, and z is from 3 to 70 mol %.

Examples of compounds represented by general formula (I) of the present invention are provided below, but the invention is not to be construed as being limited by these examples. In the examples, x, y and z represent the mol percentages of the repeating units A, B and E respectively.

A-1

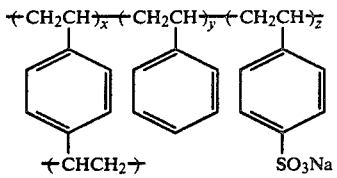

x:y:z = 10:85:5

A-2

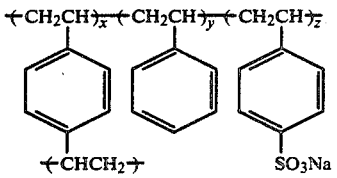

x:y:z = 10:75:15

A-3

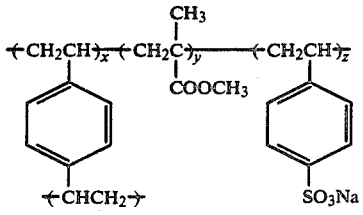

x:y:z = 1'5:70:15

-continued
A-4
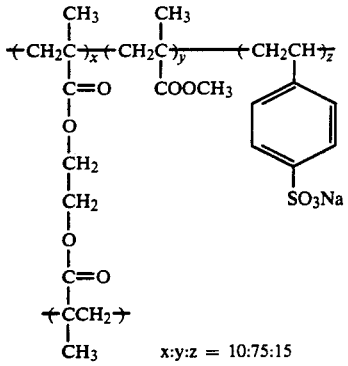
x:y:z = 10:75:15
A-5
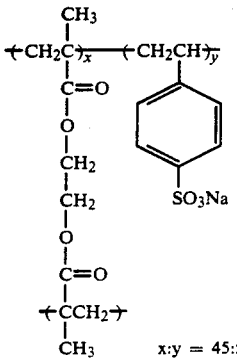
x:y = 45:55
A-6
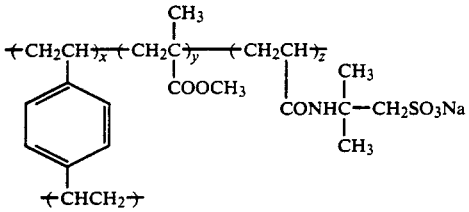
x:y:z = 15:75:10
A-7
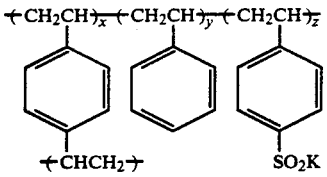
x:y:z = 15:80:5
A-8
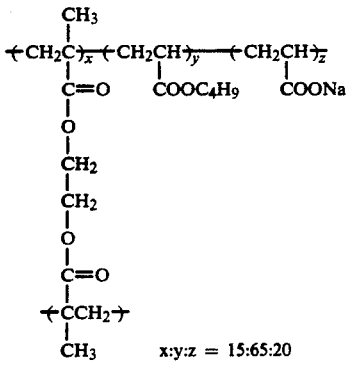
x:y:z = 15:65:20
-continued
A-9
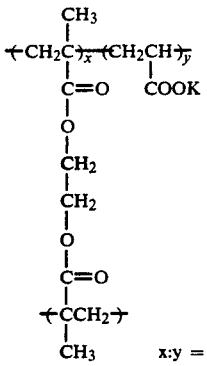
x:y = 20:80
A-10
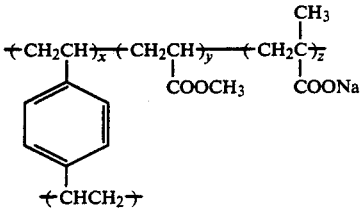
x:y:z = 10:75:15
A-11
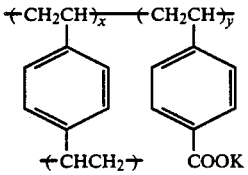
x:y = 30:70
A-12
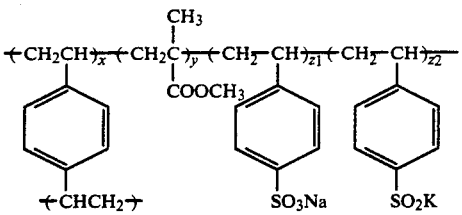
x:y:z1:z2 = 10:75:7.5:7.5
A-13
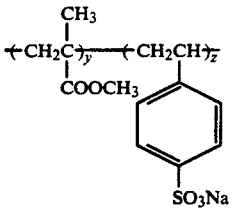
y:z = 97.5:2.5
A-14
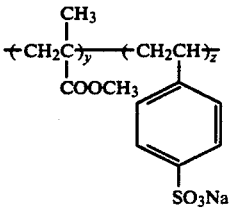
y:z = 95:5

-continued

A-15

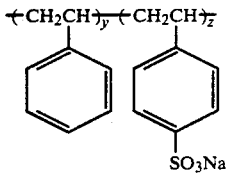

y:z = 85:15

A-16

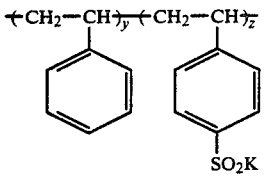

y:z = 80:20

A-17

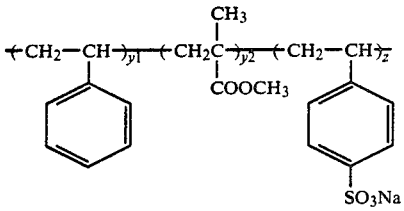

$y_1:y_2:z$ = 40:40:20

A-18

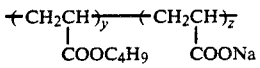

x:y = 75:25

Molecular weight of the compounds A-13 to A-18 is generally 5,000 or higher, preferably 10,000 or higher in weight average molecular weight.

The compounds represented by general formula (I) of the present invention can be prepared using well known methods of emulsion polymerization from the above described copolymerizable monomer components, namely, a copolymerizable monomer component having at least two ethylenically unsaturated groups from which the repeating unit A is derived, a monomer component having a single copolymerizable ethylenically unsaturated group from which the repeating unit B is derived, and a copolymerizable ethylenically unsaturated monomer component having at least one anionic functional group from which the repeating unit E is derived. Where the anionic groups of the polymer are derived to be in the form of a salt, the polymerization can be carried out using a monomer which is in the form of a salt, or a basic compound may be added after polymerization.

The emulsion polymerization is generally carried out at a temperature of from 30° C. to about 100° C. in the presence of at least one type of emulsifying agent selected from among the anionic surfactants (for example, sodium tetradecylsulfate or Triton 770 (marketed by the Rohm and Haas Co.)), non-ionic surfactants (for example, Emarex NP-20 (marketed by Nippon Emulsion)), gelatin or poly(vinyl alcohol) for example, and a radical polymerization initiator (for example potassium persulfate and sodium hydrogen sulfite used conjointly, marketed by Wako Pure Drug under the name V-50).

Furthermore, reference is made to the method disclosed in JP-A-61-296352 in those cases where, among the compounds represented by general formula (I), polymers which contain a large amount of anionic functional groups are being prepared.

Examples of the synthesis of polymers typical of the present invention are described below.

SYNTHESIS EXAMPLE 1

Preparation of a Divinylbenzene/styrene/sodium p-styrenesulfonate) Copolymer Dispersion (Illustrative Compound A-2)

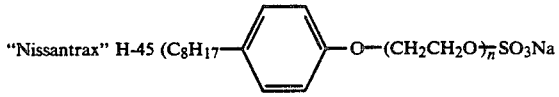

where n=4.5, 30% aqueous solution, Nippon Oil and Fat Co.) (8.77 grams), 0.32 gram of sodium hydrogen sulfite, 9.27 grams of sodium p-styrenesulfonate, 5.86 grams of divinylbenzene, 37.5 grams of styrene and 250 ml of distilled water were introduced into a reaction vessel and heated to 80° C., with stirring, under a stream of nitrogen. A solution obtained by dissolving 0.5 gram of potassium persulfate in 10 ml of distilled water was added thereto and, after heating and stirring the mixture for 2 hours, a solution obtained by dissolving 0.3 gram of potassium persulfate in 10 ml of distilled water was added and the mixture was heated and stirred for an additional 4 hours.

After cooling, the polymer dispersion obtained on filtration was a stable polymer dispersion of solid fraction 16.8 wt % and having an average particle size of 0.3 μm (measured using a Coulter Sub-micron Particle Analyzer made by the Nikkaki Corp.)

The amount of the compound represented by general formula (I) of the invention added to the mordant containing layer is from 0.1 to 200 wt %, and preferably from 0.5 to 100 wt %, with respect to the dry gelatin weight in the mordant containing layer. A "dry gelatin weight" used herein means a weight of raw gelatin which is commercially available.

If the addition amount of the compound represented by formula (I) is less than 0.1%, the viscosity of the resulting mixed solution is too low to be of practical use, while the use of more than 200wt % results in the viscosity of a mixture that is too high to be of practical use.

The compounds represented by general formula (I) of the present invention may be used not only in the mordant containing layer but also in other hydrophilic colloid layers of the photosensitive material of the present invention.

The cationic polymer of the present invention is represented by the general formula (II) indicated below.

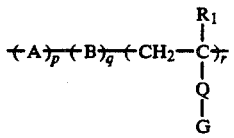

In this formula, A represents a repeating unit derived from a monomer component having at least two copolymerizable ethylenically unsaturated groups, at least one unsaturated group of which is copolymerized in a side chain of the polymer. B represents a repeating unit derived from a monomer component having a single copolymerizable ethylenically unsaturated group. $R_1$ represents a hydrogen atom, a lower alkyl group or an aralkyl group. Q represents a single bond or an alkylene group, a phenylene group, an aralkylene group or a divalent linking group represented by

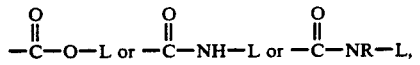

where L represents an alkylene group, an arylene group or an aralkylene group and R represents an alkyl group. G represents

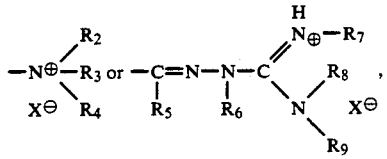

where $R_2$, $R_3$, $R_4$, $R_5$, $R_6$, $R_7$, $R_8$ and $R_9$ each represents a hydrogen atom, alkyl group, aryl group, or aralkyl group, which may be the same or different, and which may be substituted. $X^{\ominus}$ represents an anion.

Furthermore, any two of the groups Q, $R_2$, $R_3$ and $R_4$, or any two of the groups Q, $R_5$, $R_6$, $R_7$, $R_8$ and $R_9$ may be joined to form, together with the protonated nitrogen atom, a ring structure.

However, at least one of the groups $R_2$, $R_3$ and $R_4$ in the structure

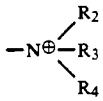

is most desirably a hydrogen atom.

Moreover, p, q and r indicate the mol percentages of the repeating units, and p has a value of from 0 to 60 mol %, q has a value of from 0 to 60 mol %, and r has a value of from 30 to 100 mol %.

The above described general formula (II) is described in detail below. The repeating units A and B are derived from the same corresponding monomer components as in the above formula (I).

$R_1$ is preferably a hydrogen atom, an alkyl group having from 1 to 6 carbon atoms (for example methyl, ethyl, n-propyl, n-butyl, n-amyl, n-hexyl) or an aralkyl group (for example, benzyl), and is most desirably a hydrogen atom or a methyl group.

Q is preferably a divalent alkylene group having from 1 to 12 carbon atoms and which may be substituted (for example, methylene or a group represented by $-(CH_2)_6-$), a phenylene group which may be substituted, or an aralkylene group having from 7 to 12 carbon atoms and which may be substituted (for example, a group represented by

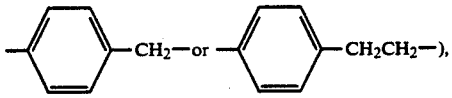

and the groups represented by the formulae below are also desirable.

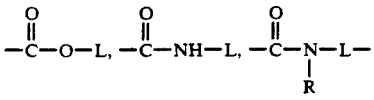

Here, L is preferably an alkylene group having from 1 to 6 carbons atoms which may be substituted, an arylene group which may be substituted, or an aralykyl group having from 7 to 12 carbon atoms and which may be substituted, and is most desirably an alkylene group having from 1 to 6 carbon atoms and which may be substituted. R is preferably an alkyl group having from 1 to 6 carbon atoms.

The substituents for alkylene group include, for example, halogen cyano, alkoxy and alkoxycarbonyl, and the substituents for phenylene and aralkylene groups include, for example, alkyl, alkoxy and aryloxy.

G represents

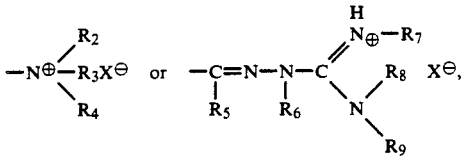

$R_2$, $R_3$, $R_4$, $R_5$, $R_6$, $R_7$, $R_8$ and $R_9$ each represents a hydrogen atom, alkyl group having from 1 to 20 carbon atoms, aryl group having from 6 to 20 carbon atoms, or aralkyl group having from 7 to 20 carbon atoms, and these groups may be the same or different. The alkyl group, aryl group and aralkyl group include substituted an alkyl group, substituted aryl group and substituted aralkyl group.

The alkyl group includes unsubstituted alkyl groups (for example, methyl, ethyl, n-propyl, iso-propyl, n-butyl, iso-butyl, tert-butyl, n-amyl, iso-amyl, n-hexyl, cyclohexyl, n-heptyl, n-octyl, 2-ethylhexyl, n-nonyl, n-decyl, n-dodecyl), and the alkyl group preferably has from 1 to 12 carbon atoms. Most desirably, the alkyl group has from 1 to 10 carbon atoms. Examples of substituted alkyl groups include alkoxyalkyl groups (for example, methoxymethyl, ethoxyethyl, methoxybutyl, ethoxyethyl, ethoxypropyl, methoxybutyl, butoxyethyl, butoxypropyl, butoxybutyl, vinyloxyethyl), cyanoalkyl groups (for example, 2-cyanoethyl, 3-cyanopropyl, 4-cyanobutyl), halogenated alkyl groups (for example, 2-fluoroethyl, 2-chloroethyl, 3-fluoropropyl), alkoxycarbonylalkyl groups (for example, ethoxycarbonylmethyl), allyl groups, 2-butenyl groups and propargyl groups.

The aryl group may be an unsubstituted aryl group (for example, phenyl, naphthyl), and the substituted aryl groups may be, for example, alkylaryl groups (for example, 2-methylphenyl, 3-methylphenyl, 4-methylphenyl, 4-ethylphenyl, 4-isopropylphenyl, 4-tertbutylphenyl), alkoxyaryl groups (for example, 4-methoxyphenyl, 3-methoxyphenyl, 4-ethoxyphenyl) or aryloxyaryl groups (for example, 4-phenoxyphenyl). The aryl group preferably has from 6 to 14 carbon atoms, and most desirably has from 6 to 10 carbon atoms. The phenyl group is the most desirable.

The aralkyl group includes an unsubstituted aralkyl group (for example, benzyl, phenethyl, diphenylmethyl, naphthylmethyl) and a substituted aralkyl group, for example alkylaralkyl groups (for example 4-methylbenzyl, 2,5-dimethylbenzyl, 4-isopropylbenzyl), alkloxyaralkyl groups (for example 4-methoxybenzyl, 4-ethoxybenzyl), cyanoaralkyl groups (for example, 4-cyanobenzyl), perfluoroalkoxyaralkyl groups (for example, 4-pentafluoropropoxybenzyl, 4-undecafluorohexyloxybenzyl) or halogenated aralkyl groups (for example, 4-chlorobenzyl, 4-bromobenzyl, 3-chlorobenzyl). The aralkyl group preferably has from 7 to 15, and most desirably from 7 to 11, carbon atoms. The benzyl group and the phenethyl group are especially desirable.

$X^{\ominus}$ represents an anion, for example a halogen ion (for example chlorine or bromine ion), an alkyl or aryl sulfonate ion (for example, methanesulfonate, ethanesulfonate, benzenesulfonate, p-toluenesulfonate), an acetate ion, a sulfate ion or a nitrate ion, and the chlorine ion, the acetate ion and the sulfate ion are especially desirable.

Furthermore, any two or more of Q, $R_2$, $R_3$ and $R_4$ are preferably joined to form, together with the nitrogen atom, a ring structure. The ring structure is preferably a pyrrolidine ring, a piperidine ring, a morpholine ring, a pyridine ring, an imidazole ring or a quinuclidine ring. The pyrrolidine, morpholine, piperidine, imidazole and pyridine rings are most desirable.

Furthermore, any two or more of Q, $R_5$, $R_6$, $R_7$, $R_8$ and $R_9$ may be joined together to form, together with the protonated nitrogen atom, a ring structure, and the ring structure that is formed is preferably a six or five membered ring structure.

Moreover, p is from 0 to 60 mol %, preferably from 0 to 40 mol %, and most desirably from 0 to 30 mol %. Furthermore, q is from 0 to 60 mol %, preferably from 0 to 40 mol %, and most desirably from 0 to 30 mol %. Furthermore, r is from 30 to 100 mol %, preferably from 40 to 95 mol %, and most desirably from 50 to 85 mol %.

Preferred useful examples of compounds represented by general formula (II) are illustrated below.

C-(1)

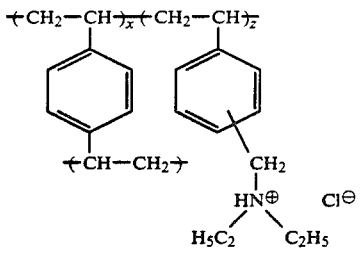

x:z = 10:90

C-(2)

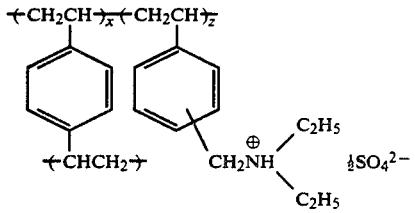

x:z = 20:80

-continued

C-(3)

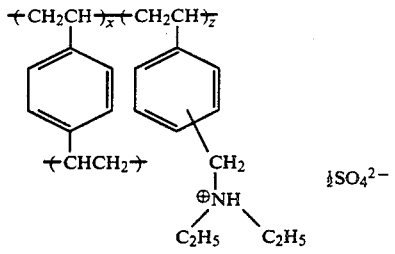

x:z = 25:75

C-(4)

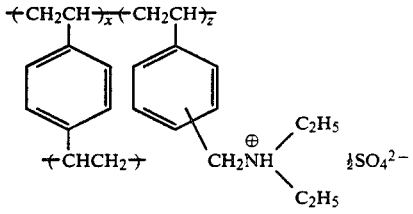

x:z = 50:50

C-(5)

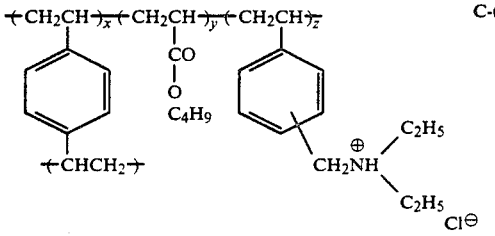

x:y:z = 50:10:40

C-(6)

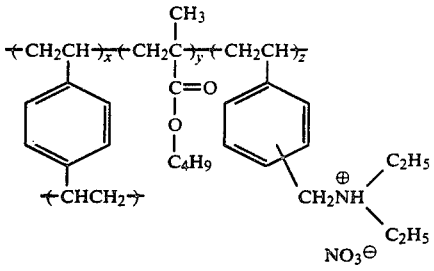

x:y:z = 45:5:50

C-(7)

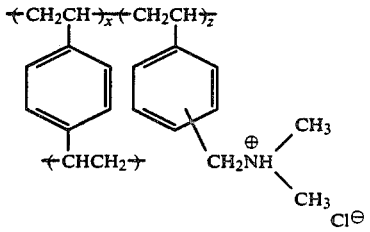

x:z = 20:80

-continued
C-(8)
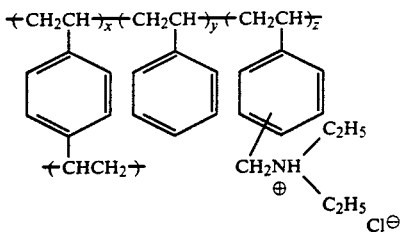
x:y:z = 15:30:55
C-(9)
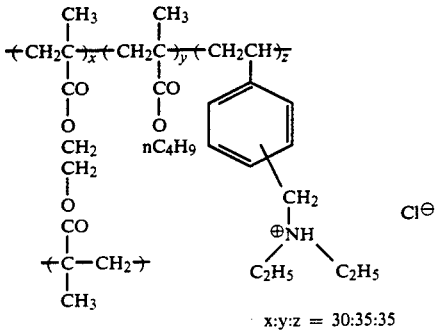
x:y:z = 30:35:35
C-(10)
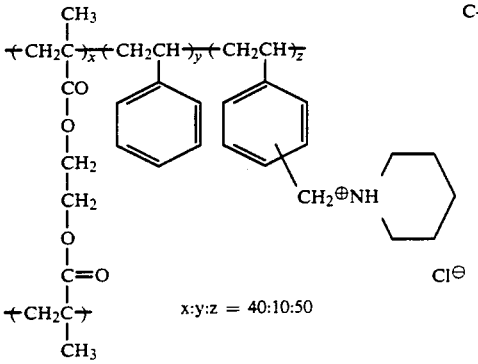
x:y:z = 40:10:50
C-(11)
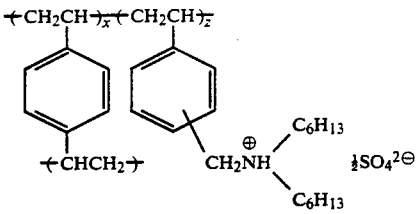
x:z = 30:70
C-(12)
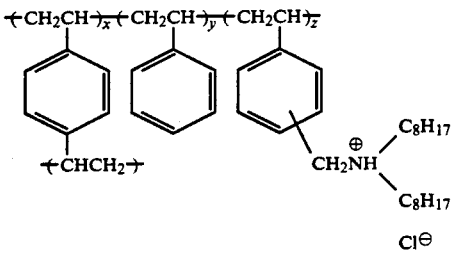
x:y:z = 12:5:80
-continued
C-(13)
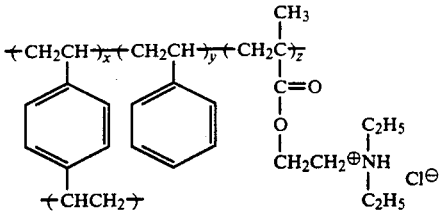
x:y:z = 15:5:80
C-(14)
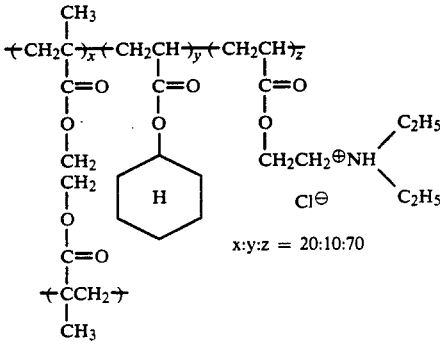
x:y:z = 20:10:70
C-(15)
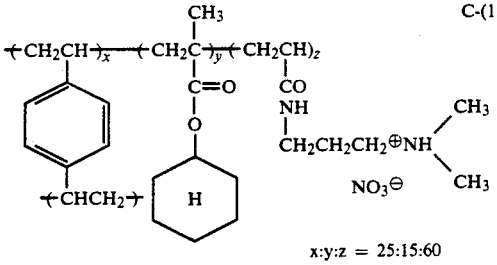
x:y:z = 25:15:60
C-(16)
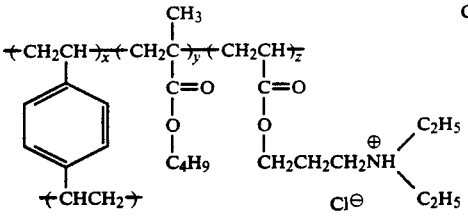
x:y:z = 15:15:70
C-(17)
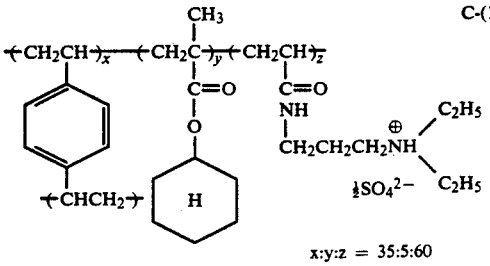
x:y:z = 35:5:60

-continued

C-(18)

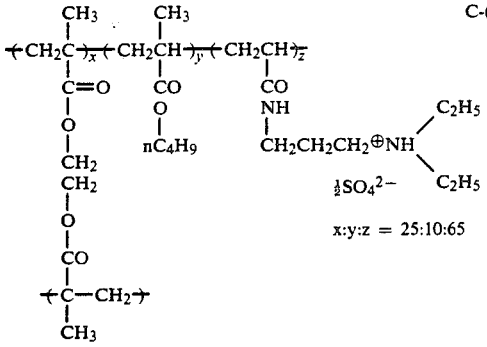

x:y:z = 25:10:65

C-(19)

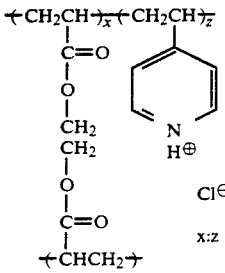

x:z = 15:85

C-(20)

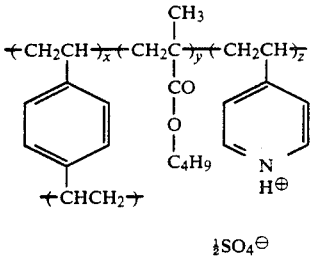

x:y:z = 20:10:70

C-(21)

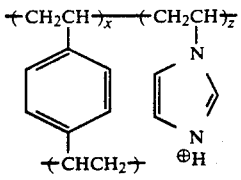

x:z = 50:50

C-(22)

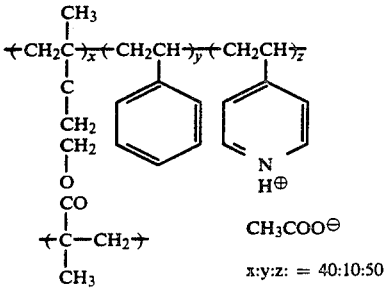

x:y:z: = 40:10:50

-continued

C-(23)

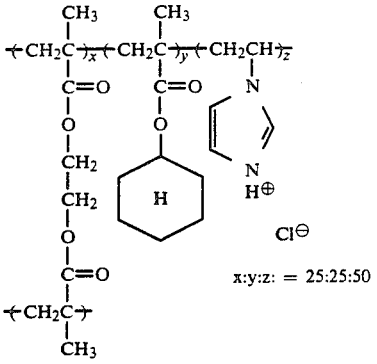

x:y:z: = 25:25:50

C-(24)

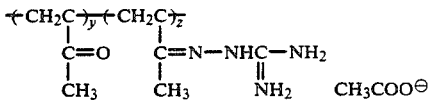

y:z = 20:80

C-(25)

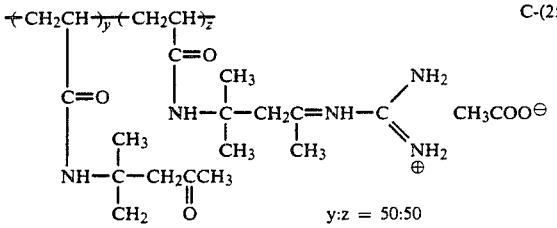

y:z = 50:50

C-(26)

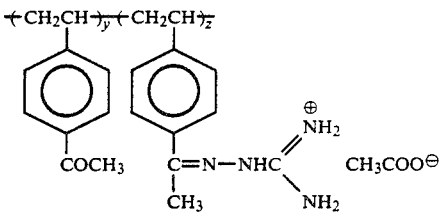

y:z = 30:70

The polymer mordant of the present invention is a cationic polymer mordant, and may be added to the photosensitive material in the form of a solution or in the form of a fine particle dispersion (latex), but fine particle dispersions are preferred for solution stability.

Crosslinkable monomers such as divinylbenzene for example can generally be used for the preparation of the cationic polymer mordant of the present invention in the form of a fine particle dispersion, but depending on the monomers used, the use of crosslinkable monomers is not essential.

Of the compounds represented by general formula (II) of the present invention, methods for the preparation of those in which G represents

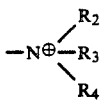

are described below.

The polymers represented by general formula (II) of the present invention can be prepared generally by polymerizing a copolymerizable monomer having at least two ethylenically unsaturated groups as described above, an ethylenically unsaturated monomer having a single unsaturated group as described above, and an unsaturated monomer represented by the formula:

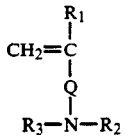

where $R_1$, $R_2$, $R_3$ and Q have the same meaning as described above and the unsaturated monomer is, for example, N,N-dimethylaminoethyl acrylate, N,N-diethylaminoethyl methacrylate, N,N-diethylaminoethyl acrylate, N-(N,N-(dimethylaminopropyl)acrylamide, N-(N,N-dihexylaminomethyl)acrylamide, 3-(4-pyridyl)propyl acrylate, N,N-diethylaminomethylstyrene, N,N-dihexylaminomethylstyrene, 2-vinylpyridine or 4-vinylpyridine, and most desirably N,N-diethylaminoethyl methacrylate or N,N-diethylaminoethyl styrene), and then forming the ammonium salt by means of a compound having the structure $R_4$—X (where $R_4$ and X have the same meaning as described above and the compound $R_4$—X is, for example, hydrochloric acid, nitric acid, sulfuric acid, p-toluenesulfonic acid, ethyl bromide, hexyl bromide, or benzyl chloride).

The polymer represented by general formula (II) of the present invention can also be prepared by polymerizing a copolymerizable monomer having at least two ethylenically unsaturated groups as described above, an ethylenically unsaturated monomer having a single unsaturated group as described above, and an unsaturated monomer represented by the general formula:

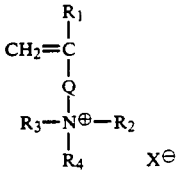

where $R_1$, $R_2$, $R_3$, $R_4$ and Q have the same meaning as described above, and the unsaturated monomer is, for example, N,N-dimethylaminoethyl methacrylate hydrochloride, N,N-diethylaminoethyl methacrylate sulfate, N,N-dimethylaminoethyl acrylate hydrochloride, N,N-diethylaminoethyl acrylate acetate, N-(N,N,N-trimethylammoniopropyl)acrylamide chloride,N-(N,N,N-trihexylammoniomethyl)acrylamide chloride, 3-(4-N-methylpyridyl) propyl acrylate, p-toluenesulfonate, N,N-dimethylaminomethylstyrene sulfate, 2-vinylpyridine hydrochloride, N,N,N-trihexylammoniomethylstyrene chloride, N,N,N-trioctylammoniomethylstyrene chloride, N,N,N-tributylammoniomethylstyrene chloride, N-benzyl-N,N-dimethylammoniomethylstyrene chloride or 4-vinylpyridine hydrochloride, and most desirably N,N,N-trihexylammoniomethylstyrene chloride and N,N,N-trioctylammoniomethylstyrene chloride.

Furthermore, the polymers represented by general formula (II) of the present invention can be prepared by polymerizing a copolymerizable monomer having at least two ethylenically unsaturated groups as described above, an ethylenically monomer having a single unsaturated group as described above, and an unsaturated monomer represented by the formula:

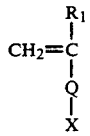

where X represents a halogen atom (for example, chlorine, bromine) or a sulfonic acid ester (for example, a p-toluenesulfonyloxy group), and $R_1$ and Q have the same meaning as above, and the unsaturated monomer is, for example β-chloroethyl methacrylate, β-p-toluenesulfonyloxyethyl methacrylate, chloromethylstyrene), and then forming the ammonium salt thereof with an amine having the structure

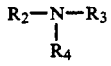

where $R_2$, $R_3$ and $R_4$ have the same meaning as above, and the amine is, for example, dimethylamine, diethylamine, iisopropylamine, morpholine, piperidine, pyridine, trimethylamine, N-methylmorpholine, tributylamine, trihexylamine, trioctylamine, triethylamine).

The compounds represented by general formula (II) of the present invention wherein G represents

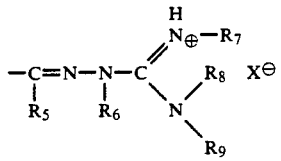

can be prepared by polymerizing a polymerizable monomer having at least two ethylenically unsaturated groups as described above, an ethylenically monomer having a single unsaturated group as described above, and an unsaturated monomer represented by the formula:

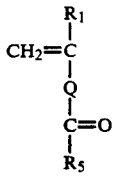

where $R_1$, $R_5$ and Q have the same meaning as described above (for example, methyl vinyl ketone, methyl (1-methylvinyl) ketone, ethyl vinyl ketone, ethyl (1-methylvinyl) ketone, n-propyl vinyl ketone, diacetoneacrylamide, diacetone acrylate, and most desirably methyl vinyl ketone, ethyl vinyl ketone, diacetoneacrylamide or diacetone acrylate), and then reacting the polymerized components with a compound represented by the general formula:

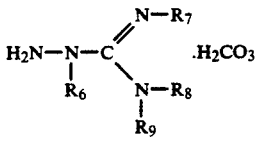

where $R_6$, $R_7$, $R_8$ and $R_9$ have the same meaning as described above, the compound then being for example, aminoguanidine bicarbonate, N-amino-N'-methylguanidine bicarbonate, N-amino-N'-methylguanidine bicarbonate, and most desirably aminoguanidine bicarbonate, and then forming the guanidinium salt thereof with a compound represented by H-X, where H-X has the same meaning as described above (for example, hydrogen chloride, hydrogen bromide, sulfuric acid, acetic acid or nitric acid).

The polymerization reactions described above can generally be carried out using known methods of solution polymerization, emulsion polymerization, suspension polymerization, precipitation polymerization and dispersion polymerization. Emulsion polymerization is preferred.

The above described emulsion polymerization is generally carried out at a temperature of from 30° C. to about 100° C., and preferably of from 40° C. to about 80° C., in the presence of at least one emulsifying agent selected from among the anionic surfactants (for example, sodium dodecylsulfonate and Triton 770 marketed by the Rohm & Haas Co.), the cationic surfactants (for example, octadecyltrimethylammonium chloride) and the non-ionic surfactants (for example, Emarex NP-20 (marketed by Nippon Emulsion), gelatin and poly(vinyl alcohol), and a radical polymerization initiator (for example, potassium persulfate and sodium hydrogen sulfite used conjointly, marketed by Wako Pure Drug Co. under the name V-50).

The above described reactions in which ammonium salts are formed are generally carried out at temperatures of from −10° C. to about 40° C., and preferably at a temperature of from 0° C. to 30° C.

The addition amount of the cationic polymer mordant depends on the type of photosensitive material employed, the application of the material and the type of layer to which the polymer dye mordant is added. The addition of from 2 to 100 grams of the polymer dye mordant per 100 grams of dry gelatin contained in the mordant containing layer is preferred, and in this case, the addition of from 1 to 40 grams of the dye to be mordanted in the mordant containing layer is desirable.

A technique wherein a solution of the polymer mordant, dye and gelatin is first prepared, and a dispersion of an anionic polymer represented by general formula (I) is subsequently added to this solution is preferably used when preparing coating liquids, to prevent aggregation in the liquid.

Moreover, a technique wherein a first liquid containing the polymer mordant, dye and gelatin, and a second liquid containing a dispersion of an anionic polymer represented by general formula (I) and gelatin are prepared individually, and the two liquids are then mixed together is especially desirable.

It is thought that the above described technique provides preferred results because each polymer is protected by the gelatin such that there is no direct interaction between the cationic polymer mordant and the anionic polymer thickener represented by the general formula (I).

Furthermore, the thickener represented by the general formula (I) of the present invention constitutes a fine particle dispersion, in which the fine particle has a particle range of 0.01 to 2 μm, and therefore has little adverse effect on interlayer adhesion properties even when added in a large amount to provide a pronounced increase in viscosity.

The silver halide photosensitive material of this present invention may contain one or more dyes in the photographic emulsion layers or other hydrophilic layers in order to absorb light of a specified wavelength range (for example, to prevent halation or irradiation), or to control the spectral composition of the light incident on a photographic emulsion layer (for example, a filter layer).

The dyes which can be mordanted in the mordant containing layer of the photosensitive material of the present invention include acidic dyes (for example, dyes having a sulfo group, a carboxyl group, a sulfonamido group or a phenolic hydroxyl group). Acidic dyes having a sulfo group or carboxyl group are preferred, and these include the oxonol dyes which have a pyrazolone nucleus or a barbituric acid nucleus as disclosed, for example, in British Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161223, JP-A-59-111640, JP-B-39-22069, JP-B-43-13168, and U.S. Pat. Nos. 3,247,127, 3,469,985 and 4,078,933, the other oxonol dyes ad disclosed, for example, in U.S. Pat. Nos. 2,533,472 and 3,379,533 and British Patent 1,278,621, the azo dyes disclosed, for example, in British Patents 575,691, 680,631, 599,623, 786,907, 907,125 and 1,045,609, U.S. Pat. No. 4,255,326 and JP-A-59-211043, the azomethine dyes as disclosed, for example, in JP-A-50-100116, JP-A-54-118247, and British Patents 2,014,598 and 750,031, the anthraquinone dyes as disclosed, for example, in U.S. Pat. No. 2,865,752, the arylidine dyes as disclosed, for example, in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303, the styryl dyes as disclosed, for example, in JP-B-28-3082, JP-B-44-16594 and JP-B-59-28898, the triarylmethane dyes as disclosed, for example, in British Patents 446,583 and 1,335,422, and JP-A-59-228250, the merocyanine dyes as disclosed, for example, in British Patents 1,075,653, 1,153,341, 1,284,730, 1,475,228 and 1,542,807, and the cyanine dyes as disclosed, for example, in U.S. Pat. Nos. 2,843,486 and 3,294,539. Furthermore, the dyes disclosed, for example, in U.S. Pat. Nos. 4,294,916 and 4,294,917, JP-A-56-12639, JP-A-63-27838, JP-A-63-197943, British Patent 1,563,809, European Patent 15,601 and International Patent (WO) 88/04794, can also be used. Of the above noted dyes, the oxonol dyes which have a pyrazolone nucleus are especially desirable.

Examples of dyes for mordanting in the mordant containing layer of the present invention are illustrated below, but the invention is not to be construed as being limited by these examples.

I-1
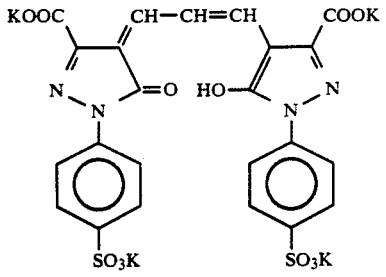
I-2
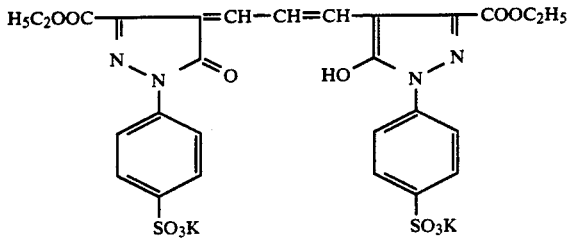
I-3
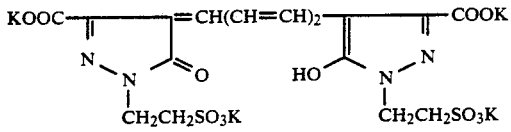
I-4
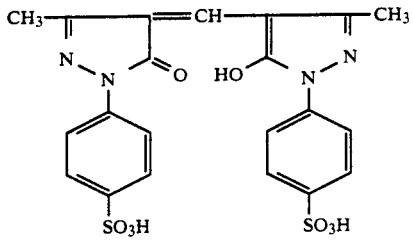
I-5
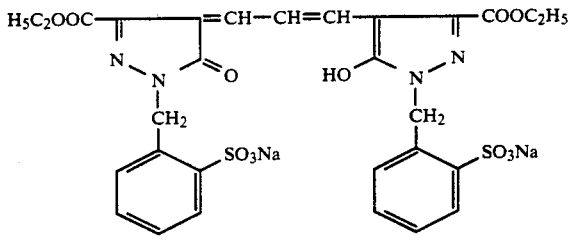
I-6
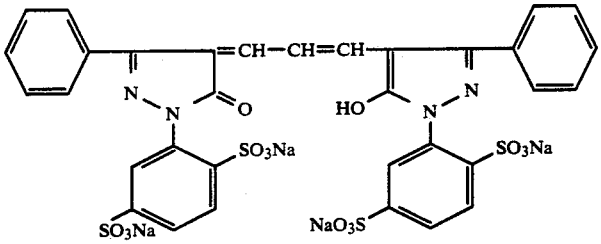
I-7
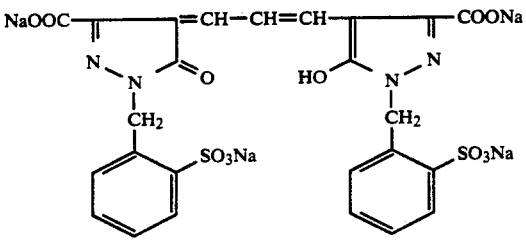

-continued
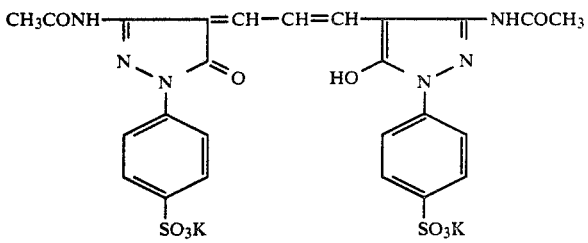
I-8
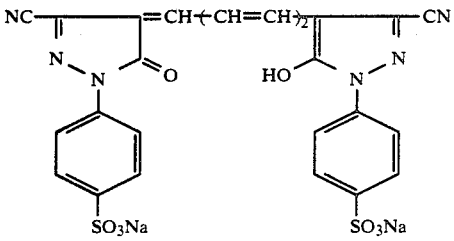
I-9
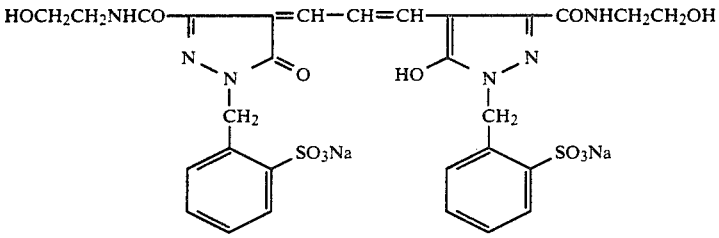
I-10
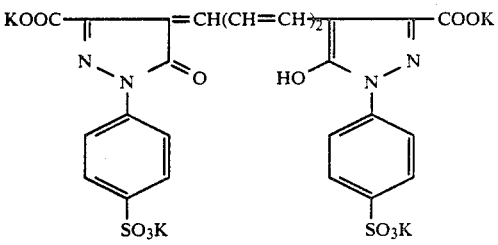
I-11
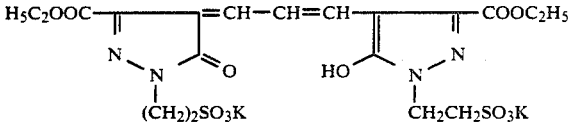
I-12
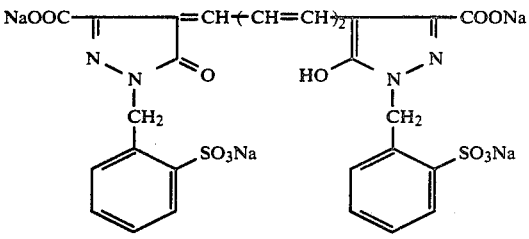
I-13
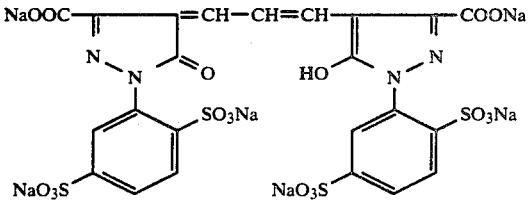
I-14

-continued
I-15
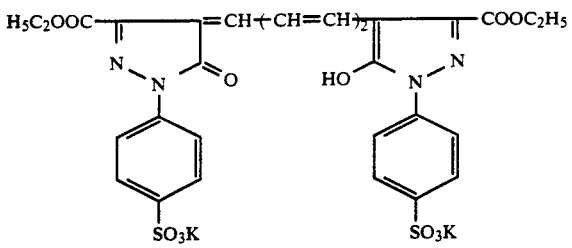
I-16
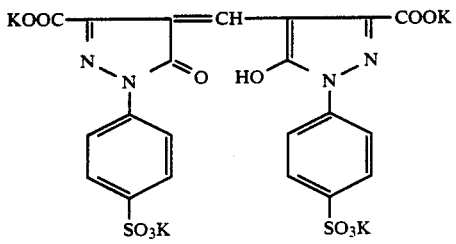
I-17
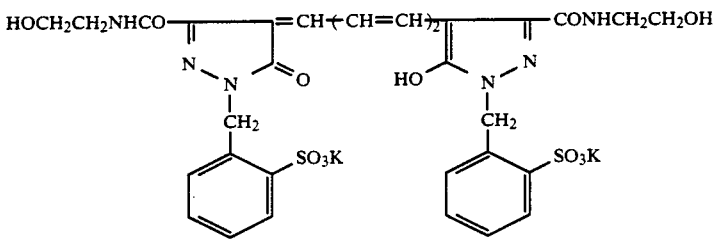
I-18
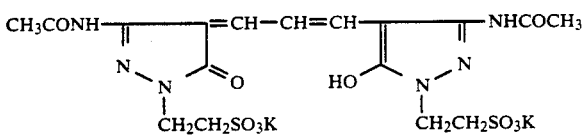
I-19
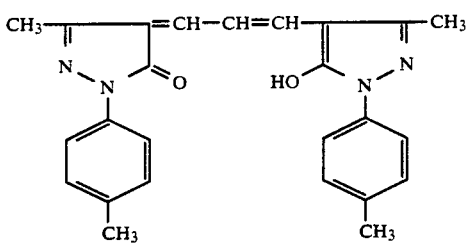
I-20
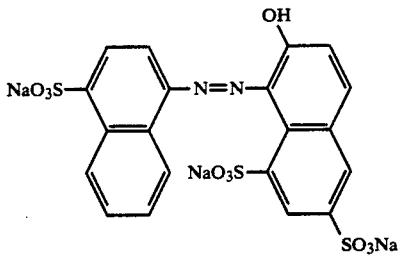
I-21
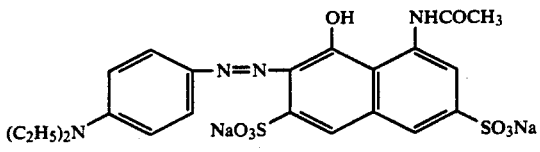

-continued
I-22
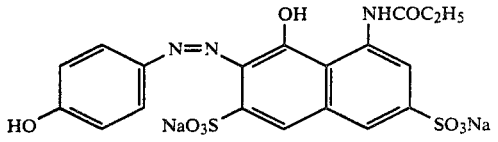
I-23
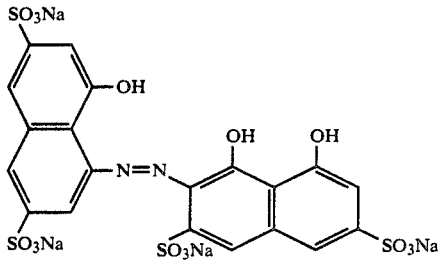
I-24
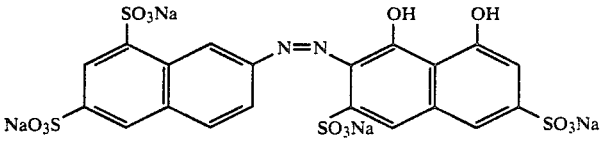
I-25
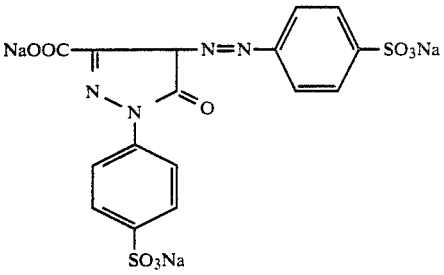
I-26
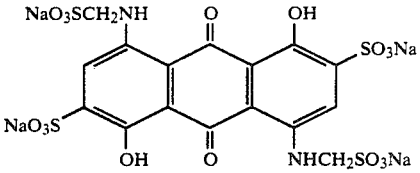
I-27
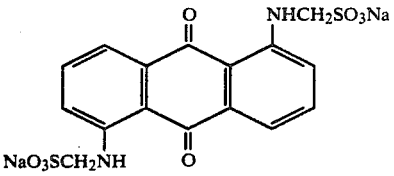
I-28
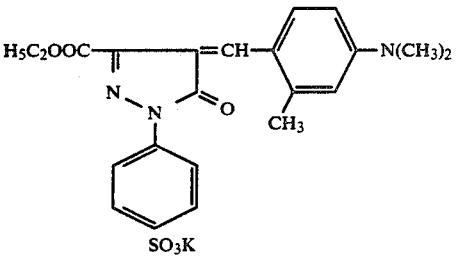

-continued
I-29
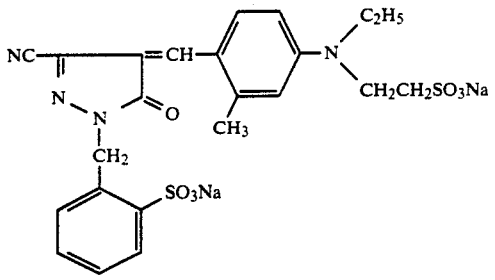
I-30
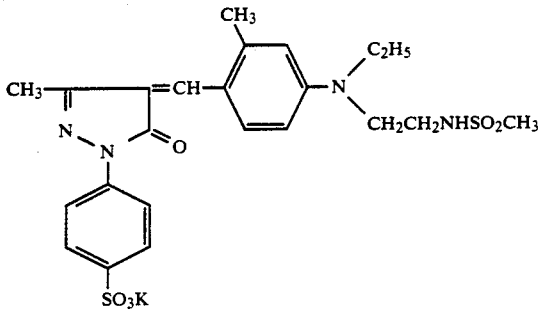
I-31
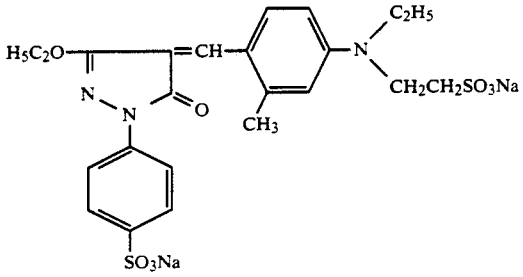
I-32
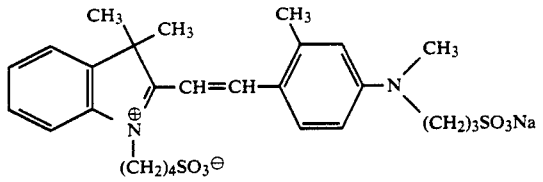
I-33
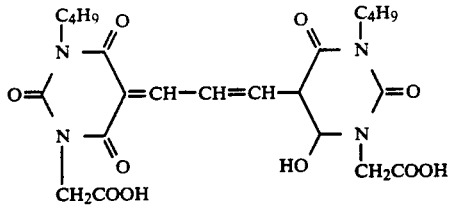
I-34
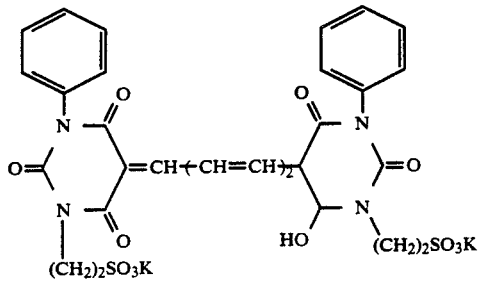

-continued
I-35
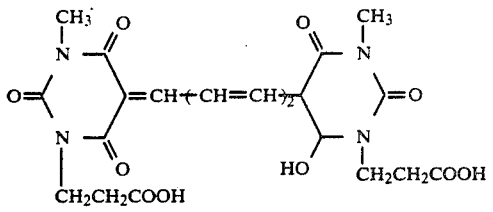
I-36
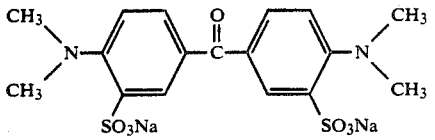
I-37
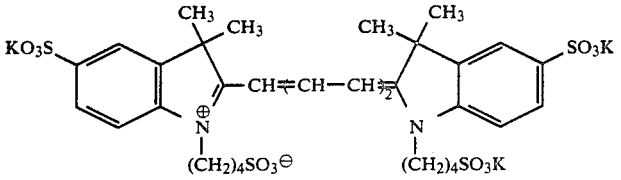
I-38
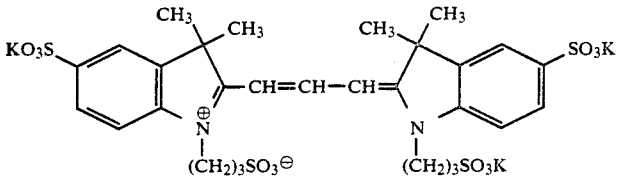
I-39
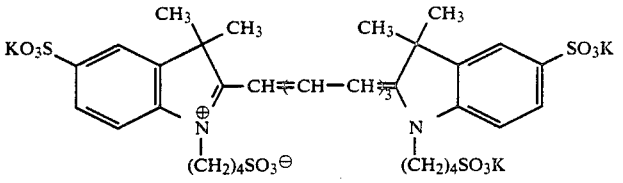
I-40
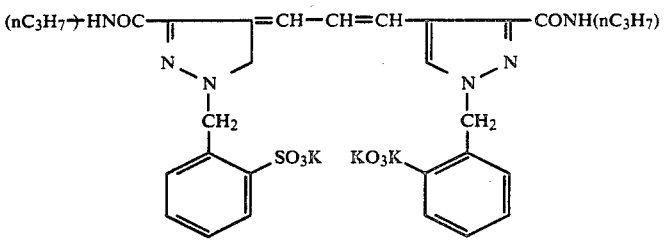
I-41
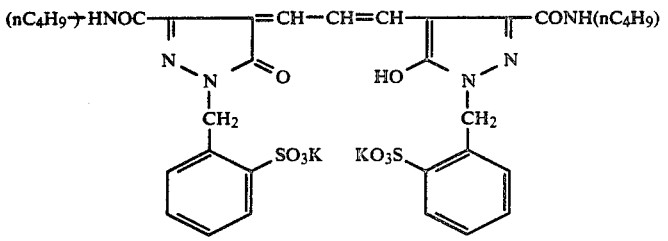

-continued
I-42
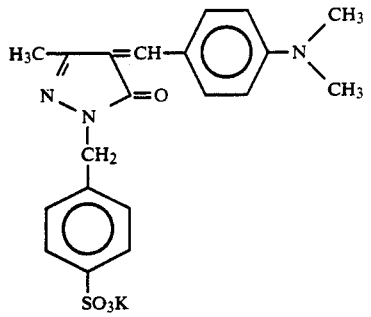
I-43
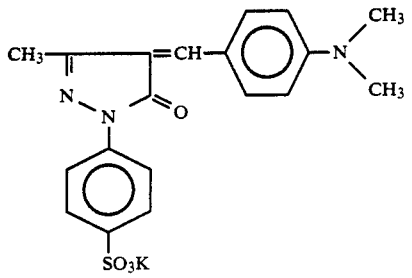
I-44
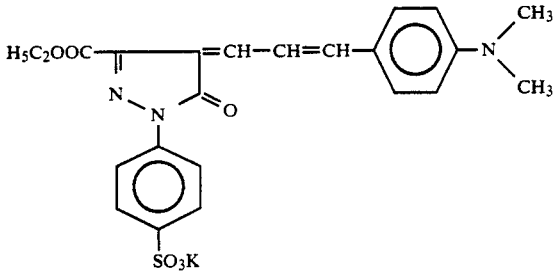
I-45
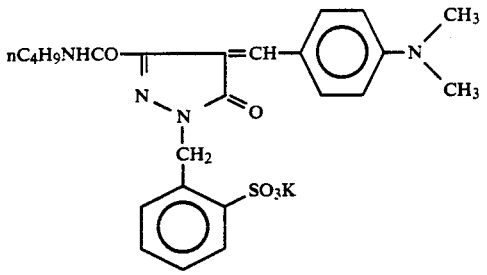
I-46
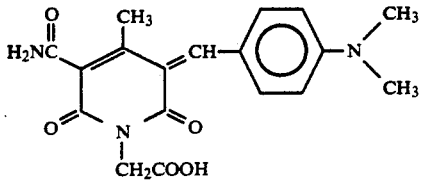

-continued
I-47
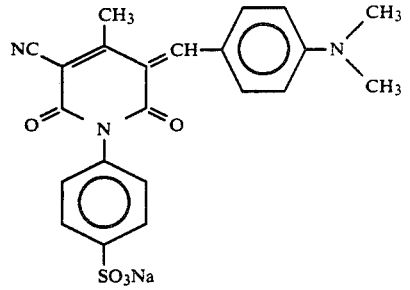
I-48
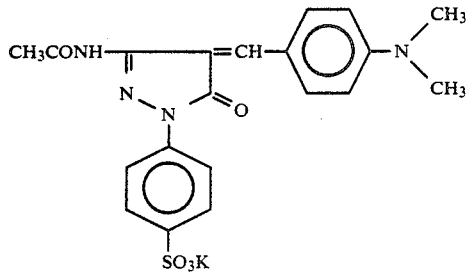
I-49
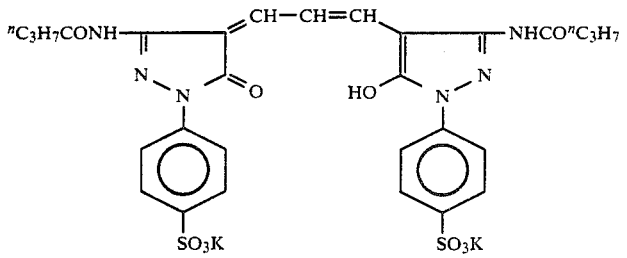
I-50
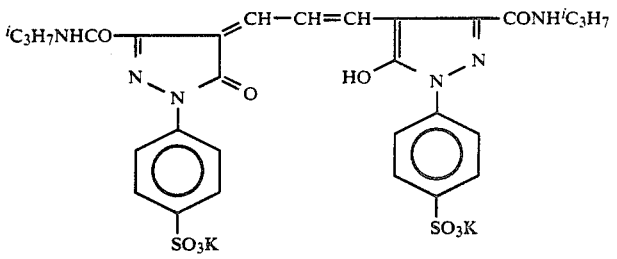
I-51
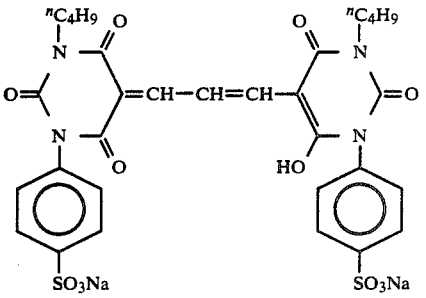

-continued
I-52
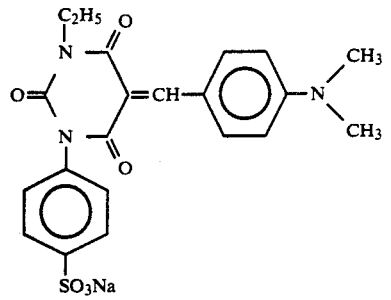
I-53
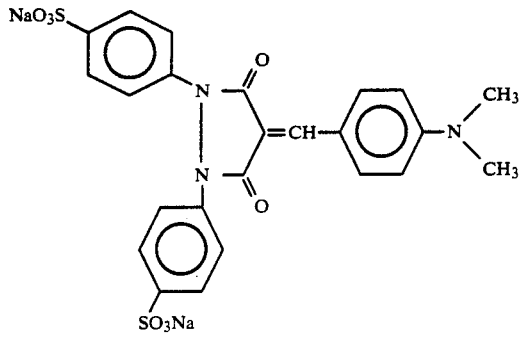
I-54
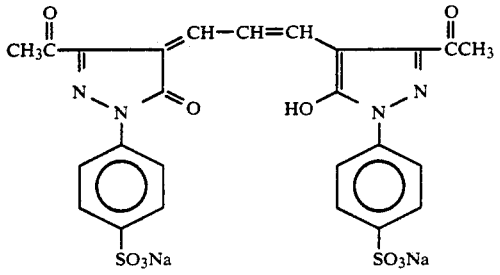
I-55
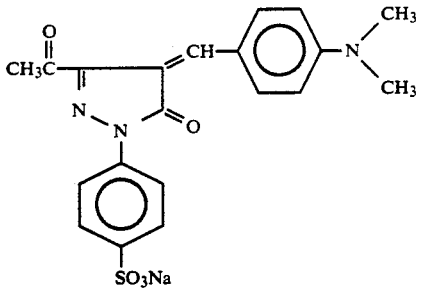
I-56
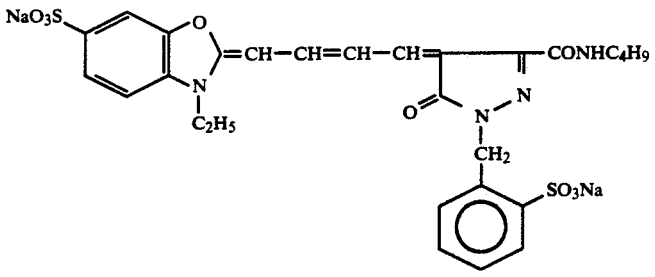

-continued

I-57

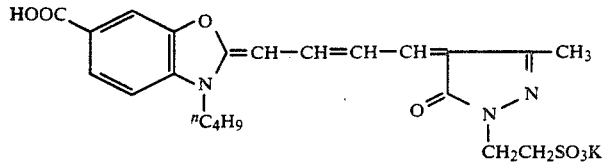

I-58

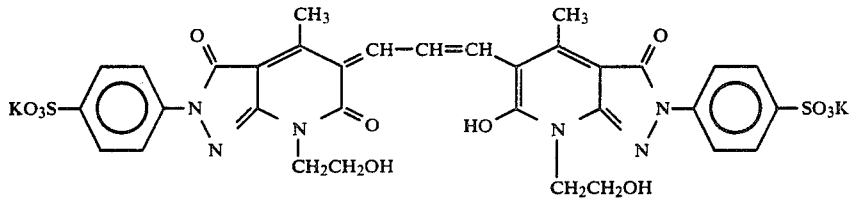

I-59

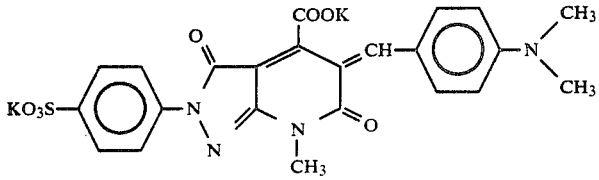

I-60

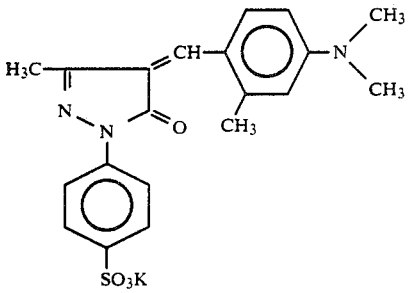

The silver halide grains contained in the silver halide emulsions for use in the photosensitive material of the present invention may have a regular crystalline form such as a cubic, octahedral, rhombododecahedral or tetradecahedral form, or may have an irregular crystalline form such as a spherical or tabular form, or may have a form which is a composite of these crystalline forms. Furthermore, the silver halide grains may be tabular grains having an aspect ratio of at least 5 as disclosed in *Research Disclosure,* volume 225, pages 20 to 58 (January 1983).

Furthermore, the grains may have an epitaxial structure, or a multi-layer structure such that the interior and surface thereof have different compositions (for example, different halide compositions).

Furthermore, the average grain size of the grains is preferably at least than 0.5 μm, and is most desirably at least 0.7 μm and not more than 5.0 μm.

Furthermore, the grain size distribution may be wide or narrow. A narrow grin size distribution is known as a monodisperse emulsion and the dispersion coefficient is preferably not more than 20%, and preferably not more than 15%. (Here, the dispersion coefficient is the value obtained by dividing the standard deviation by the average grain size.)

The photographic emulsions for use in the present invention can be prepared using the methods disclosed, for example, by P. Glafkides in *Chimie et Physique Photographique,* published by Paul Montel, 1967, by G. F. Duffin in *Photographic Emulsion Chemistry,* published by Focal Press, 1966, and by V. L. Zelikmann et al. in *Making and Coating Photographic Emulsions,* published by Focal Press, 1964. Namely, the photographic emulsion can be prepared using an acidic method, neutral method or ammonia method, for example, using a single sided mixing procedure, a simultaneous mixing procedure or a combination of such procedures for reacting the soluble silver salt with the soluble halide.

The photographic emulsion for use in the present invention may consist of any combination of silver chloride, silver bromide, silver iodide, silver iodobromide, silver chloroiodobromide and silver chloroiodide.

The average iodide content of the entire photographic emulsion contained in the photosensitive material of the present invention is preferably at least 3 mol %, and most desirably at least 8 mol %, and not more than 40 mol %.

Furthermore, the coated silver weight of the photosensitive material of the present invention is preferably from 1 to 20 g/m$^2$, and most desirably from 2 to 10 g/m$^2$.

Furthermore, the total silver iodide (AgI) content in the silver halide photosensitive material of the present invention is preferably at least $4\times10^{-3}$ mol/m$^2$, and it is most desirably at least $6\times10^{-3}$ mol/m$^2$ and not more than $4\times10^{-2}$ mol/m$^2$.

Cadmium salts, zinc salts, lead salts, thallium salts, iridium salts or complex salts thereof, rhodium salts or complex salts thereof, or iron salts or complex salts thereof may be present at the formation or physical ripening stages of the silver halide grains.

Gelatin, proteins such as casein, cellulose compounds such as carboxymethylcellulose and hydroxyethylcellulose, agar, dextran, sodium alginate and sugar derivatives such as starch derivatives, synthetic hydrophilic polymers, for example poly(vinyl alcohol), poly-N-vinylpyrrolidone, poly(acrylic acid) copolymers, polyacrylamide or derivatives and partial hydrolyzates of these materials can be used as the binder for the emulsion layers and other hydrophilic colloid layers of the silver halide photosensitive material of the present invention.

Here, the term "gelatin" includes lime treated gelatin, acid treated gelatin and enzyme treated gelatin. The lime treated gelatin is preferably used in the mordant containing layer.

Furthermore, the photosensitive material of the present invention may contain the alkyl acrylate based latexes disclosed, for example, in U.S. Pat. Nos. 3,411,911 and 3,411,912 and JP-B-45-5331 within the photographic structural layers.

The emulsions for use in the photosensitive silver halide emulsion layers of the present invention are preferably subjected to chemical sensitization.

The methods described in the aforementioned publications by Glafkides and Zelikman, or in *Die Grundlagen der Photographishen Prozesse mit Silberhalogeniden,* by H. Frieser, (published by Akademische Verlagsgesellschaft, 1968) can be used for chemical sensitization.

Namely, sulfur sensitization methods in which active gelatin or compounds which contain sulfur which react with silver, reduction sensitization methods, and precious metal sensitization methods can all be used either individually or in combination. Thiosulfates, thioureas, thiazoles, rhodanines and other compounds can be used as the sulfur sensitizing agents. Stannous salts, amines, hydrazine derivatives, formamidinesulfinic acid and silane compounds, for example, can be used as the reducing substances. Complex salts of metals of group VIII of the Periodic Table, such as platinum, iridium and palladium for example, can be used as well as gold complex salts for the precious metal sensitization.

Various compounds can be included in the photosensitive material of the present invention as stabilizers, including azoles, for example benzothiazolium salts, nitroindazoles, triazoles, benzotriazoles and benzimidazoles (especially nitro or halogen substituted derivatives thereof); heterocyclic mercapto compounds, for example mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines; heterocyclic mercapto compounds as described above but which have water solubilizing groups such as carboxyl groups and sulfo groups; thioketo compounds, for example oxazolinthione; azaindenes, for example tetraazaindenes (especially 4-hydroxy substituted (1,3,3a,7)-tetraazaindenes); benzenethiosulfonic acids; and benzenesulfinic acid.

Surfactants can be included in the photographic emulsion layers or other hydrophilic colloid layers of the photosensitive material of the present invention as, for example, coating promotors or anti-static agents, to improve slip properties, for emulsification and dispersion, for the prevention of sticking and for improving photographic performance (for example, for accelerating development, increasing contrast or increasing speed).

For example, use can be made of non-ionic surfactants such as saponin (steroid based), alkylene oxide derivatives (for example, polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (for example, alkenylsuccinic acid polyglyceride, alkylphenol polyglyceride), fatty acid esters of polyhydric alcohols and sugar alkyl esters; anionic surfactants which have acidic groups, such as carboxylic acid groups, sulfo groups, phospho groups, sulfate ester groups and phosphate ester groups, for example, alkylcarboxylates, alkylsulfonates, alkylbenzenesulfonates, alkylnaphthalenesulfonates, alkyl sulfate esters, alkyl phosphate esters, N-acyl-N-alkyltaurines, sulfosuccinate esters, sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides; and cationic surfactants, such as alkylamine salts, aliphatic or aromatic quaternary ammonium salts, heterocyclic quaternary ammonium salts, for example pyridinium salts and imidazolium salts, and phosphonium salts and sulfonium salts which contain aliphatic or heterocyclic rings. The use of the polyoxyethylene based surfactants from among these surfactants, and fluorine containing surfactants, is especially desirable.

The polyoxyethylene based surfactants for use in the present invention preferably has at least two, and most desirably from 2 to 100, oxyethylene groups.

The surfactants represented by the general formulae (III-1), (III-2) and (III-3) indicated below are preferred for use as the polyoxyethylene based surfactants.

$$R_1-A\leftarrow CH_2CH_2O\rightarrow_{n1}R_2$$ General Formula (III-1)

General Formula (III-2)

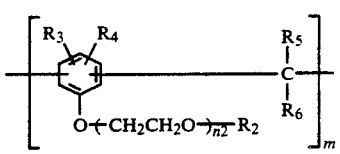

General Formula (III-3)

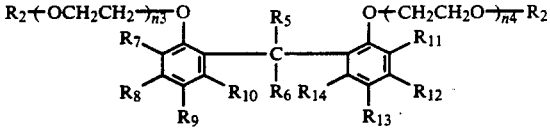

In the above formulae, $R_1$ represents a hydrogen atom or a substituted or unsubstituted alkyl group having from 1 to 30 carbon atoms, an alkenyl group or an aryl group, and A represents —O—, —S—, —COO—, $$-\underset{|}{N}-R_{15},\ -CO-\underset{|}{N}-R_{15},\ \text{or}\ -SO_2\underset{|}{N}-R_{15}$$

where $R_{15}$ represents a hydrogen atom or a substituted or unsubstituted alkyl group. $R_2$ has the same meaning as $R_1$ described above, or $R_1$—A—.

$R_3$, $R_4$, $R_8$, $R_{10}$, $R_{12}$ and $R_{14}$ each represents a hydrogen atom, substituted or unsubstituted alkyl group, aryl groups, alkoxy group, halogen atom, acyl group, amide group, sulfonamide group, carbamoyl groups or sulfamoyl group. Furthermore, $R_7$, $R_9$, $R_{11}$ and $R_{13}$ in the above formulae each represents a substituted or unsubstituted alkyl group, aryl group, alkoxy group, halogen atom, acyl group, amide group, sulfonamide group, carbamoyl group or sulfamoyl group.

$R_5$ and $R_6$ each represents a hydrogen atom, substituted or unsubstituted alkyl group, aryl group or heterocyclic group.

Moreover, n1, n2, n3 and n4 indicate the average degree of polymerization of ethylene oxide, and are each numbers of at least 2, desirably from 2 to 100.

Furthermore, m is the average degree of polymerization, and is a number of from 5 to 50.

The amount of polyoxyethylene based surfactant for use in the present invention depends on the type and form of the photosensitive material being employed and the method used for coating, for example, but is generally at least 6.0 mg, and most desirably at least 60 ml and not more than 5 g, per mol of silver.

The polyoxyethylene based surfactant for use in the present invention is preferably added to a photosensitive emulsion layer of the photosensitive material, but it can be added to a non-photosensitive layer.

The compounds disclosed, for example, in JP-B-59-7724, JP-B-57-53933, Japanese Patent Application No. 61-61208 and U.S. Pat. No. 3,022,172 can be added to increase the viscosity of the coating liquids for the photosensitive material of the present invention. The use of water soluble polymers such as poly(styrenesulfonic acid) or poly(3,3-acrylamidomethylpropanesulfonic acid) is especially desirable. However, the use of these compounds in layers which contain polymer mordants or the layers adjacent thereto in the photosensitive material of the present invention is undesirable.

Inorganic or organic film hardening agents may be included in the photographic emulsions and non-photosensitive hydrophilic colloid layers of the present invention. For example, chromium salts, aldehydes (for example, formaldehyde, glutaraldehyde), N-methylol compounds (for example, dimethylolurea), active vinyl compounds (for example, 1,3,5-triacryloyl-hexahydro-s-triazine, bis(vinylsulfonyl)methyl ether, N,N'methylenebis[$\beta$-(vinylsulfonyl)propionamide]), active halogen compounds (for example, 2,4-dichloro-6-hydroxy-s-triazine), mucohalogenic acids (for example, mucochloric acid), N-carbamoylpyridinium salts (for example, (1-morpholinocarbonyl-3-pyridinio)methanesulfonate) and haloamidinium salts (for example, 1-(1-chloro-1-pyridinomethylene)pyridinium 2-naphthalenesulfonate) can be used individually or in combinations for this purpose. From among these compounds, the active vinyl compounds disclosed in JP-A-53-41220, JP-A-53-57257, JP-A-59-162546 and JP-A-60-80846, and the active halogen compounds disclosed in U.S. Pat. No. 3,325,287 are preferred.

The photographic emulsion of the present invention can be spectrally sensitized by means of methine dyes or other dyes. Cyanine dyes, merocyanine dyes, complex cyanine dyes, complex merocyanine dyes, holopolar cyanine dyes, hemi-cyanine dyes, styryl dyes and hemioxonol dyes are included among the dyes which can be used. Any of the nuclei normally employed as the basic heterocyclic nuclei in a cyanine dye can be used. Namely, pyrroline, oxazoline, thiazoline, pyrrole, oxazole, thiazole, selenazole, imidazole, tetrazole and pyridine nuclei, nuclei wherein the above noted nuclei are fused with an aliphatic hydrocarbone ring and nuclei wherein the above noted nuclei are fused with an aromatic hydrocarbone ring, namely indolenine, benzindolenine, indole, benzoxazole, naphthoxazole, benzothiazole, naphthothiazole, benzoselenazole, benzimidazole and quinoline nuclei, can be employed. The carbon atoms contained in the nuclei may be substituted.

Five or six membered heterocyclic nuclei such as the pyrazolin-5-one, thiohydantoin, 2-thiooxazolin-2,4-dione, thiazolidin-2,4-dione, rhodanine and thiobarbituric acid nuclei can be used as the nuclei for a ketomethylene structure in the merocyanine dyes or complex merocyanine dyes.

The amount of sensitizing dye for use in the present invention is preferably from $1'10^{-6}$ to $5\times10^{-3}$ mol per mol of silver.

Colored image forming couplers, namely compounds which react with the oxidation product of an aromatic amine (usually primary aromatic amine) developing agent and form a dye (these compounds are referred to hereinafter as couplers) may be included in the photographic emulsion of the present invention. The couplers contain hydrophobic groups known as ballast groups within the coupler molecule. The couplers may be either four-equivalent or two-equivalent with respect to silver ion. Furthermore, colored couplers which have a color correcting effect, and couplers which release development inhibitors as development proceeds (e.g., DIR couplers) may be included. The coupler may also be of the type which provides a colorless coupling reaction product.

The known open chain ketomethylene based couplers can be used as yellow color forming couplers. The benzoylacetanilide based compounds and pivaloylacetanilide based compounds are useful among these compounds.

Pyrazolone compounds, indazolone based compounds and cyanoacetyl compounds can be used as magenta couplers, and the pyrazolone based compounds are especially useful.

Phenol based compounds and naphthol based compounds, for example, can be used as cyan couplers.

The protective layer of the silver halide photosensitive material of the present invention is a layer containing a hydrophilic colloid, and the hydrophilic colloids described above can be used for this purpose. Furthermore, the protective layer may comprise a single layer or multiple layers.

Matting agents and/or smoothing agents, for example, may be added to the emulsion layer or protective layer, and preferably to the protective layer, of the silver halide photosensitive material of the present invention. Organic compounds such as water dispersible vinyl polymers, for example poly(methyl methacrylate), or inorganic compounds, such as silver halide, strontium barium sulfate for example, having an appropriate particle size (a grain size of 0.3 to 5 $\mu$m, or a grain size of at least twice, and preferably at least four times the thickness of the protective layer) are preferably used as the matting agent. Smoothing agents are used to prevent adhesive failure in a manner similar to the matting agents, and are especially effective for improving the friction characteristics which contribute to the camera suitability of cinematographic films during shooting and projection. Useful examples of smoothing agents include liquid paraffin, waxes such as the esters of high fatty acids, polyfluorinated hydrocarbons and derivatives thereof, polyalkylpolysiloxanes, polyarylpolysiloxanes, polyalkylarylpolysiloxanes and the alkylene oxide adduct derivatives of these materials.

Intermediate layers and filter layers, for example, can also be provided in the silver halide photosensitive material of the present invention as required.

Preferred applications of the silver halide photosensitive material of the present invention include X-ray photosensitive materials, lith photosensitive materials, black-and-white shooting photosensitive materials, color negative photosensitive materials, color reversal photosensitive materials, and color printing papers. Black-and-white shooting applications are especially desirable.

Various other additives can be used in the photosensitive material of the present invention as required. For example, development accelerators, fluorescent whiteners, anti-color fogging agents and ultraviolet absorbers can be used in this way. In practical terms, those disclosed in *Research Disclosure* No. 176, pages 28 to 30 (RD-17643, 1978) can be used.

Typical supports for use in the photosensitive material of the present invention include cellulose nitrate films, cellulose acetate films, poly(vinyl acetate) films, poly(vinyl acetol) films polystyrene films, poly(ethylene terephthalate) films and other polyesters, and glass, paper, metals and wood.

Reference is made to *Research Disclosure* 17643, pages 28 to 30, in connection with the development processing of the photosensitive material of the present invention.

Furthermore, Fujifix, Super Fujifix, Fuji DP Fix, and Super Fuji Fix DP, made by the Fuji Photographic Film Co., F-6 and Kodak Fixer made by the Kodak Co. U.S.A., Konifix and Konifix Rapid made by the Konishiroku Co., and Olifix, Myfix, Niwafix, Nissan Rapid Fixer, Nissan Rapid Fixer P, Panfix F, Panfix P, Myroll F and Oriental QF, for example, can be used as fixers for processing the photosensitive material of the present invention.

The invention is described in detail below by means of the following illustrative examples, but the invention is not to be construed as being limited by these examples. Unless noted otherwise, all parts and percentages are given by weight.

EXAMPLE 1

(1) Preparation of a Mordant Containing Layer Coating Liquid

(a) Preparation of a Gelatin Solution Containing Mordant and Acidic Dye

A 3% aqueous solution of the acidic dye I-(12) (23 ml) and 38 ml of a 3% aqueous solution of the dye I-(3) were added, with stirring, to 45 ml of a 15% aqueous dispersion of the mordant C-(2) to prepare a mixed mordant — dye solution. This mixed mordant — dye solution was added, with stirring, to 580 ml of a 6.3% aqueous gelatin solution to prepare a gelatin solution (A) containing a mordant and acidic dyes.

(b) Preparation of a Gelatin Solution Containing Thickener

A 13% aqueous dispersion of the compound A-4 and 300 ml of water were added, with stirring, to 130 ml of a 14% aqueous gelatin solution to prepare a gelatin solution (B) containing a thickener.

(c) Preparation of a Mordant Containing Layer Coating Liquid

Whole amount of solution (A) was added gradually, with stirring, to the solution (B) to prepare the mordant containing layer coating liquid 1.

Coating liquids 2 to 8 were prepared in the same way as coating liquid 1, except that the thickener was changed to as indicated in Table 1. Solution (B) of the coating liquid 8 was prepared using 360 ml of a 13% aqueous solution of thickener and 180 ml of water.

(2) Measurement of Viscosity

A type DVL-B rotary viscosimeter, manufactured by Tokyo Keiki Seisakusho, was used to measure the viscosity at 38° C., of the coating liquids 1 to 8. Furthermore, the coating liquids thus prepared were evaluated for the presence or absence of aggregates. The results obtained are as shown in Table 1.

TABLE 1

| Coating Liquid | Thickener | Viscosity cp | Aggregates Formed |
|---|---|---|---|
| 1 | A-4 | 65 | No |
| 2 | A-3 | 63 | No |
| 3 | A-15 | 60 | No |
| 4 | None | 8 | No |
| 5 | Comparative Thickener (1) | 26 | Yes |
| 6 | Comparative Thickener (2) | 25 | No |
| 7 | Comparative Thickener (3) | 20 | No |
| 8 | Comparative Thickener (2) (1.5 times the amount of Coating Liquid 6 was added) | 38 | No |

Comparative Thickener (1)

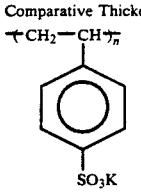

Comparative Thickener (2)

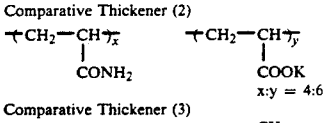

x:y = 4:6

Comparative Thickener (3)

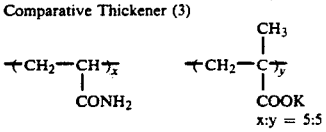

x:y = 5:5

It is clearly seen from Table 1 that coating liquids 1 to 3 containing a compound represented by general formula (I) of the present invention had higher viscosities than the coating liquids containing the comparative thickeners having weight average molecular weight of 1,500,000 yet there was no aggregation of the coating liquids prepared in accordance with the present invention. Thus, the compounds represented by general formula (I) of the present invention are excellent thickeners.

EXAMPLE 2

(1) Preparation of Photosensitive Silver Halide Emulsion

Potassium bromide (25 grams), 15 grams of potassium iodide, 1.9 grams of potassium thiocyanate and 24 grams of gelatin were introduced into a container holding 1 liter of water, and the container was heated to 60° C. An aqueous silver nitrate solution and an aqueous potassium bromide solution were added in accordance with the ammonia method using double jet addition with vigorous agitation, while maintaining the mixture at 60° C. A thick tabular and nearly amorphous silver iodobromide having an iodide content of 10 mol % and an average grain size of 1.0 μm was obtained. Subsequently, 300 mg of the dye A was added, and then chemical sensitization was carried out using sodium thiosulfate and chloroauric acid to obtain the photosensitive silver iodobromide emulsion (A). The photosensitive silver iodobromide emulsion (B) of iodide content 6 mol % and average grain size 0.6 μm was obtained in a similar manner as emulsion (A), except that the amount of iodide in the solution initially was 9 grams, and the temperature was set at 40° C. Dye A:

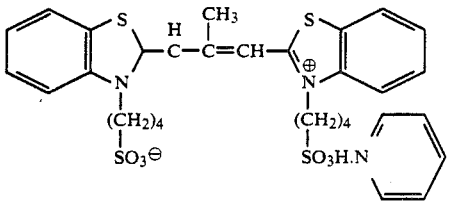

Preparation of Coated Samples

Coating samples 1 to 8 were prepared by coating the formulation indicated below and layers 1 to 5 were prepared on the emulsion coating side of a triacetylcellolose support in accordance with the method disclosed in JP-A-62-115035. The support prepared in accordance with JP-A-62-115035 had a subbing layer previously established on the emulsion coating surface, and the subbing layer thereof consisted of the following:

| | |
|---|---|
| 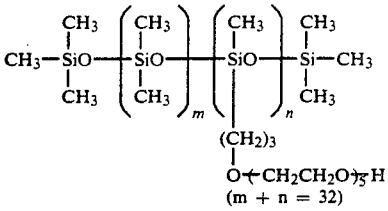 (m + n = 32) | 10 mg/m² |
| 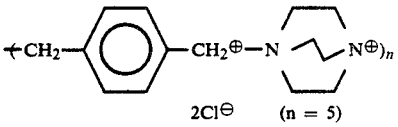 2Cl⊖ (n = 5) | 60 mg/m² |
| Diacetylcellulose | 143 mg/m² |
| Silicon oxide | 5 mg/m² |
| First Layer (mordant Containing Layer) | |
| The coating liquids 1 to 8 of Example 1 were coated to provide 1.0 gram of gelatin per square meter in each case. | |
| Second Layer (Intermediate Layer) | |
| Gelatin | 0.4 g/m² |

-continued

| | |
|---|---|
| 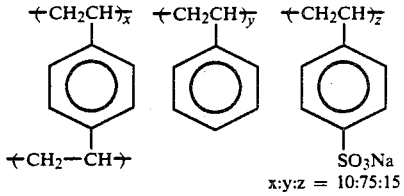 x:y:z = 10:75:15 | 0.24 g/m² |
| Third Layer (Emulsion Layer) | |
| Emulsion (B) was used | |
| Coated silver weight | 1.36 g/m² |
| Weight of gelatin | 2.0 g/m² |
| 4-Hydroxy-6-methyl-1,3,3a,7-tetraazaindene | 30 mg/m² |
| $C_{18}H_{35}O(CH_2CH_2O)_{25}H$ | 7 mg/m² |
| 2,3-Hydroxynaphthalene | 1.5 mg/m² |
| Poly(potassium p-vinylbenzenesulfonate), having weight average molecular weight of 1,500,000 | 50 mg/m² |
| Bis(vinylsulfonylacetamido)ethane | 57 mg/m² |
| Fourth Layer (Emulsion Layer) | |
| Emulsion (A) was used | |
| Coated silver weight | 4.7 g/m² |
| Weight of gelatin | 7.3 g/m² |
| 4-Hydroxy-6-methyl-1,3,3a,7-tetraazaindene | 41 mg/m² |
| $C_{18}H_{35}O(CH_2CH_2O)_{25}H$ | 23 mg/m² |
| $CH_3CH_2C(CH_2OH)_3$ | 390 mg/m² |
| Poly(potassium p-vinylbenzenesulfonate) | 88 mg/m² |
| 2-Pnenoxyethanol, having weight average molecular weight of 1,500,000 | 73 mg/m² |
| Fifth Layer (Surface Protective Layer) | |
| Gelatin | 0.8 g/m² |
| $C_8F_{17}SO_2N(C_3H_7)-CH_2COOK$ | 1.8 mg/m² |
| 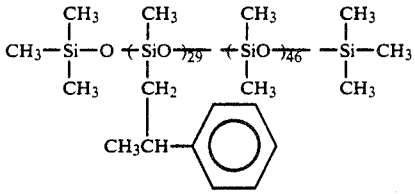 | 43 mg/m² |
| Coating Promotor | 10 mg/m² |
| 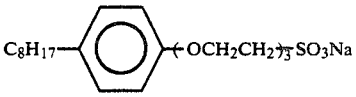 | |
| Matting Agent: Fine poly(methyl methacrylate)Particles (Average particle size 3 μm) | 0.13 mg/m² |

(3) Sensitometry

These samples were stored for 14 days at 30° C., 65% RH after coating. Each sample was then tested using the procedures described below.

(i) Wet Adhesion Test (Peeling Test)

Two orthogonal scratches were made using a steel point on the photographic emulsion surface of the film in the processing bath for each of the development, fixing and washing stages, and the scratched part was rubbed with a fingertip in a direction at right angles to the scratched line.

Those cases where there was no peeling of the emulsion layer over the scratch were designated class A, where the peeling was appeared at more 3 mm in width were designated class B and where the peeling was appeared over 3 mm in width were designated class C.

(ii) Sensitivity Test

The various samples were exposed for 0.1 second through an optical wedge using a tungsten light of 400 lux, and the samples were then developed for 7 minutes at 20° C. in the development bath indicated below.

The samples were fixed, washed and dried and the photographic speed was measured at a fixed density (an optical density of 0.2) above the fog density using the same procedure for each sample.

The results obtained are as shown in Table 2.

| | |
|---|---|
| Developer | |
| Metol | 2 grams |
| Sodium sulfite | 100 grams |
| Hydroquinone | 5 grams |
| Borax.$10H_2O$ | 2 grams |
| Water | to make 1 liter |
| Fixer | |
| Fujifix | |
| (Made by the Fuji Photo Film Co.) | |

TABLE 2

| Sample Number | Coating Liquid | Coated Surface State | Adhesion | Photographic Speed |
|---|---|---|---|---|
| 1 (Invention) | 1 | ○ | A | 100 |
| 2 (Invention) | 2 | ○ | A | 100 |
| 3 (Invention) | 3 | ○ | A | 100 |
| 4 (Comp. Ex) | 4 | X | A | 100 |
| 5 (Comp. Ex) | 5 | X | C | 85 |
| 6 (Comp. Ex) | 6 | Δ | B | 100 |
| 7 (Comp. Ex) | 7 | Δ | B | 100 |
| 7 (Comp. Ex) | 8 | ○ | C | 92 |

Samples 1 to 3 of this present invention all exhibited a good coated surface state. On the other hand, the emulsion layer in Comparative Sample 4 showed coating irregularities such as flow. Coating irregularities similar to those of Sample 4 were also observed in Comparative Samples 6 and 7. The coating liquid of comparative Sample 5 was aggregated, and the coated film surface was matted.

It is clearly seen from Table 2 that the coated surface state is improved without adversely affecting photographic speed or adhesion by including thickeners of the present invention in the same layer containing the acidic dye and the mordant.

EXAMPLE 3

Coated samples 9 to 18 were prepared in the same way as in Example 2, except that the mordant, acidic dye and thickener were changed to as indicated in Table 3. The results obtained are as shown in Table 3.

TABLE 3

| Sample Number | Cationic Polymer Mordant (Amount Added) | Acidic Dye (Amount Added) | Thickener (Amount Added) | Coated Surface State | Adhesion | Photographic Speed |
|---|---|---|---|---|---|---|
| 9 (Comp. Ex.) | None | I-12 (12.3 mg/m$^2$) (20.8 mg/m$^2$) | Comparative Thickener (1) (58 mg/m$^2$) | ○ | A | 62 |
| 10 (Comp. Ex.) | C-2 (120 mg/m$^2$) | I-3 | None | X | A | 100 |
| 11 (Invention) | C-6 (150 mg/m$^2$) | I-3 | A-4 (570 mg/m$^2$) | ○ | A | 100 |
| 12 (Invention) | C-8 (120 mg/m$^2$) | I-3 | A-4 (570 mg/m$^2$) | ○ | A | 100 |
| 13 (Invention) | C-24 (120 mg/m$^2$) | I-3 | A-4 (570 mg/m$^2$) | ○ | A | 100 |
| 14 (Invention) | C-2 (120 mg/m$^2$) | I-12 (12.7 mg/m$^2$) I-28 (15.0 mg/m$^2$) | A-9 (450 mg/m$^2$) | Δ | A | 100 |
| 15 (Invention) | C-2 (120 mg/m$^2$) | I-12 (12.7 mg/m$^2$) I-3 (20.8 mg/m$^2$) | A-14 (720 mg/m$^2$) | ○ | A | 100 |
| 16 (Invention) | C-2 (120 mg/m$^2$) | I-12 (2.8 mg/m$^2$) I-3 (20.8 mg/m$^2$) | A-17 (450 mg/m$^2$) | ○ | A | 100 |
| 17 (Invention) | C-2 (120 mg/m$^2$) | I-18 (14.3 mg/m$^2$) I-13 (22.6 mg/m$^2$) | A-18 (600 mg/m$^2$) | Δ | A | 100 |
| 18 (Invention) | C-2 (120 mg/m$^2$) | I-12 (8.5 mg/m$^2$) I-3 (6.2 mg/m$^2$) I-31 (10.2 mg/m$^2$) | A-4 (570 mg/m$^2$) | ○ | A | 100 |

It is clearly seen from Table 3 that Samples 11 to 18 of the present invention had an improved coated surface state without loss of photographic speed, and without adversely effecting the adhesion properties, While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising a support having thereon at least one silver halide photosensitive layer and at least one layer containing an acidic dye, a cationic polymer mordant and gelatin, wherein said mordant containing layer further contains a dispersion of an anionic polymer thickener represented by formula (I):

$$\text{-}(A)_x\text{-}(B)_y\text{-}(E)_z\text{-} \quad \text{(I)}$$

wherein A represents a repeating unit derived from a monomer component having at least two copolymerizable ethylenically unsaturated groups, at least one unsaturated group of which is copolymerized in a side chain of the polymer; B represents a repeating unit derived from a monomer component having a single copolymerizable ethylenically unsaturated group; E represents a repeating unit derived from a copolymerizable ethylenically unsaturated monomer component having at least one anionic functional group; x, y and z represent the mol percentages of the repeating units A, B and E respectively, and x is from 3 to 50 mol %, y is from 0 to 80 mol %, and z is from 3 to 70 mol %.

2. A silver halide photosensitive material as in claim 1, wherein the mordant containing layer contains the anionic polymer thickener represented by formula (I) in an amount of from 0.1 to 200 wt % based on the amount of dry gelatin contained therein.

3. A silver halide photosensitive material as in claim 1, wherein the cationic polymer mordant is represented by the formula (II):

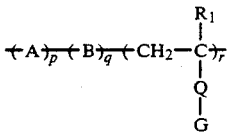

where A represents a repeating unit derived from a monomer component having at least two copolymerizable ethylenically unsaturated groups, at least one unsaturated group of which is copolymerized in a side chain of the polymer; B represents a repeating unit derived from a monomer component having a single copolymerizable ethylenically unsaturated group; $R_1$ represents a hydrogen atom, an alkyl group having from 1 to 6 carbon atoms or an aralkyl group; Q represents a single bond or an alkylene group, a phenylene group, an aralkylene group or a divalent linking group represented by —C—O—L—, —C—NH—L— or —C—NR—L—, where L represents an alkylene group, an arylene group or an aralkylene group and R represents an alkyl group; G represents

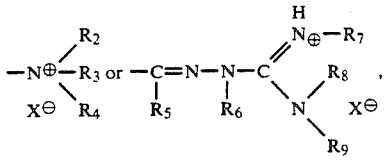

where $R_2$, $R_3$, $R_4$, $R_5$, $R_6$, $R_7$, $R_8$ and $R_9$ each represents a hydrogen atom, alkyl group, aryl group, or aralkyl group; $X^{\ominus}$ represents an anion; or any two of the groups Q, $R_2$, $R_3$ and $R_4$, or any two of the groups Q, $R_5$, $R_6$, $R_7$, $R_8$ and $R_9$ join to form, together with the protonated nitrogen atom, a ring structure; and p, q and r represent the mol percentages of the respective repeating units, and p is from 0 to 60 mol %, q is from 0 to 60 mol % and r is from 30 to 100 mol %.

4. A silver halide photosensitive material as in claim 1, wherein the mordant containing layer contains the cationic polymer mordant in an amount of from 2 to 100 grams per 100 grams of dry gelatin.

5. A silver halide photosensitive material as in claim 1, wherein the mordant containing layer contains the acidic dye in an amount of from 1 to 40 grams per 100 grams of dry gelatin.

6. A silver halide photosensitive material as in claim 1, wherein a coating liquid for the mordant containing layer is prepared by mixing together a first liquid containing the polymer mordant, dye and gelatin, and a second liquid containing a dispersion of the anionic polymer thickener and gelatin.

* * * * *